US008882647B2

(12) United States Patent
Thomas et al.

(10) Patent No.: US 8,882,647 B2
(45) Date of Patent: Nov. 11, 2014

(54) EQUIPMENT FOR INSERTION OF OBJECTS INTO SMOKING ARTICLES

(75) Inventors: Timothy Frederick Thomas, High Point, NC (US); Robert William Benford, Kemersville, NC (US); Barry Smith Fagg, Winston-Salem, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 0 days.

(21) Appl. No.: 12/329,794

(22) Filed: Dec. 8, 2008

(65) Prior Publication Data

US 2009/0090372 A1 Apr. 9, 2009

Related U.S. Application Data

(62) Division of application No. 11/234,834, filed on Sep. 23, 2005, now Pat. No. 7,479,098.

(51) Int. Cl.
*B31C 99/00* (2009.01)

(52) U.S. Cl.
USPC ..... 493/39; 493/40; 493/50; 493/941

(58) Field of Classification Search
USPC ..... 493/39, 40, 42, 45, 47, 48, 50, 941; 131/275, 84.1
See application file for complete search history.

(56) References Cited

U.S. PATENT DOCUMENTS 1,726,737 A 9/1929 Harris
2,808,057 A 10/1957 Jaksch (Continued)

FOREIGN PATENT DOCUMENTS

BE 1007973 A7 11/1995
CA 2416144 1/2002

(Continued)

OTHER PUBLICATIONS

International Preliminary Report on Patentability from PCT Application No. PCT/US2004/027786, which corresponds to U.S. Appl. No. 10/661,807, dated Mar. 23, 2006.

(Continued)

*Primary Examiner* — Sameh H. Tawfik
(74) *Attorney, Agent, or Firm* — Brinks Gilson & Lione

(57) ABSTRACT

Apparatus incorporating a filter tow processing unit adapted to supply filter tow to a continuous rod forming unit includes an object insertion unit that positions objects within the filter tow to manufacture a filter rod containing objects positioned at predetermined intervals. The apparatus also includes an upper hopper that acts as a reservoir for a plurality of objects, and provides for supply of objects to a lower hopper. The lower hopper is shaped so that objects are stacked therein. The bottom of the lower hopper is shaped so as to cooperate with a portion of upper region of a rotating wheel. The peripheral face of the rotating wheel incorporates a plurality of spaced pockets, each pocket being of sufficient shape and size to accommodate one object. Objects within the lower hopper are aligned in a single line along a portion of the peripheral face in the upper region of the rotating wheel. Each object then is positioned at predetermined intervals within a continuous supply of filter material. Then, the filter material is formed into a continuous rod having individual objects positioned at predetermined spaced intervals within that rod. The continuous rod then is subdivided at predetermined intervals so as to form a plurality of filter rods (e.g., four-up filter rods containing four spaced objects).

10 Claims, 9 Drawing Sheets

(56) References Cited

U.S. PATENT DOCUMENTS 2,852,987 A 9/1958 Shanz
2,863,461 A 12/1958 Frost, Jr.
2,881,770 A 4/1959 Touey
3,066,681 A 12/1962 Cohn
3,101,723 A 8/1963 Seligman et al.
3,188,924 A 6/1965 Davey et al.
3,217,715 A 11/1965 Berger et al.
3,236,244 A 2/1966 Irby et al.
3,270,750 A 9/1966 Campbell
3,279,476 A 10/1966 Noznick et al.
3,288,145 A 11/1966 Rosenthal
3,288,147 A 11/1966 Molins et al.
3,297,038 A 1/1967 Homburger
3,308,600 A 3/1967 Erdmann et al.
3,311,519 A 3/1967 Touey et al.
3,334,636 A 8/1967 Zuber
3,339,557 A 9/1967 Karalus
3,339,558 A 9/1967 Waterbury
3,347,247 A 10/1967 Lloyd
3,349,780 A 10/1967 Lloyd
3,366,121 A 1/1968 Carty
3,370,595 A 2/1968 Davis et al.
3,390,039 A 6/1968 Caughman et al.
3,390,686 A 7/1968 Irby, Jr. et al.
3,413,982 A 12/1968 Sublett et al.
3,420,242 A 1/1969 Boukair
3,424,172 A 1/1969 Neurath et al.
3,428,049 A 2/1969 Leake et al.
3,508,558 A 4/1970 Seyburn
3,513,859 A 5/1970 Carty
3,515,146 A 6/1970 Nealis
3,525,582 A 8/1970 Waterbury
3,547,130 A 12/1970 Harlow et al.
3,550,508 A 12/1970 Wartman, Jr. et al.
3,575,180 A 4/1971 Carty
3,596,665 A 8/1971 Lindgard
3,599,646 A 8/1971 Berger et al.
3,602,231 A 8/1971 Dock
3,602,235 A 8/1971 Dock
3,625,228 A 12/1971 Dock
3,635,226 A 1/1972 Horsewell et al.
3,648,711 A 3/1972 Berger et al.
3,669,128 A 6/1972 Cohen
3,683,936 A 8/1972 O'Neil, Jr.
3,685,521 A 8/1972 Dock
3,731,451 A * 5/1973 Sexstone et al. ..... 53/435
3,797,644 A 3/1974 Shaw
3,805,682 A 4/1974 Lyon et al.
3,818,223 A 6/1974 Gibson
3,834,285 A 9/1974 Schubert et al.
3,844,200 A 10/1974 Sexstone
3,915,176 A 10/1975 Heitmann et al.
3,916,914 A 11/1975 Brooks et al.
3,957,563 A 5/1976 Sexstone
3,972,335 A 8/1976 Tiggelbeck et al.
3,978,185 A 8/1976 Buntin et al.
3,991,773 A 11/1976 Walker
4,003,387 A 1/1977 Goldstein
4,005,668 A 2/1977 Washington et al.
4,016,830 A 4/1977 Sexstone
4,044,659 A 8/1977 Bardenhagen et al.
4,046,063 A 9/1977 Berger
4,046,153 A 9/1977 Kaye
4,064,791 A 12/1977 Berger
4,075,936 A 2/1978 Berger
4,082,098 A 4/1978 Owens, Jr.
4,126,141 A 11/1978 Grossman
4,168,712 A 9/1979 Labbe
4,174,719 A 11/1979 Martin et al.
4,174,720 A 11/1979 Hall
4,174,780 A * 11/1979 Farrar et al. ..... 209/536
4,184,412 A 1/1980 Hall
4,201,234 A 5/1980 Neukomm
4,214,508 A 7/1980 Washington
4,223,597 A 9/1980 Lebet
4,238,993 A 12/1980 Brand et al.
4,273,600 A 6/1981 Luke
4,280,187 A 7/1981 Reuland et al.
4,281,670 A 8/1981 Heitmann et al.
4,281,671 A 8/1981 Bynre et al.
4,284,088 A 8/1981 Brand et al.
4,291,713 A 9/1981 Frank
4,311,720 A 1/1982 Marmo et al.
4,331,166 A 5/1982 Hale
4,357,950 A 11/1982 Berger
4,425,107 A 1/1984 Hall ..... 493/48
4,474,190 A 10/1984 Brand
4,476,807 A 10/1984 Pryor
4,508,525 A 4/1985 Berger
4,549,875 A 10/1985 Pryor
4,572,216 A * 2/1986 Josuttis et al. ..... 131/70
4,574,816 A 3/1986 Rudszinat
4,574,958 A * 3/1986 Manservisi ..... 209/535
4,677,995 A 7/1987 Kallianos et al.
4,700,723 A 10/1987 Yoshikawa et al.
4,714,082 A 12/1987 Banerjee et al.
4,729,391 A 3/1988 Woods et al.
4,736,754 A 4/1988 Heitmann et al.
4,756,318 A 7/1988 Clearman et al.
4,763,674 A 8/1988 Lelah
4,763,775 A 8/1988 Jefferys et al. ..... 198/533
4,771,795 A 9/1988 White et al.
4,781,203 A 11/1988 La Hue
4,793,365 A 12/1988 Sensabaugh, Jr. et al.
4,807,809 A 2/1989 Pryor et al.
4,811,745 A 3/1989 Cohen et al.
4,821,749 A 4/1989 Toft et al.
4,844,100 A 7/1989 Holznaget
4,848,375 A 7/1989 Patron et al.
4,850,301 A 7/1989 Greene, Jr. et al.
4,862,905 A 9/1989 Green, Jr. et al.
4,865,056 A 9/1989 Tamaoki et al.
4,870,748 A 10/1989 Hensgen et al.
4,878,506 A 11/1989 Pinck et al.
4,881,555 A 11/1989 Bolt et al.
4,889,144 A 12/1989 Tateno et al.
4,903,714 A 2/1990 Barnes et al.
4,917,128 A 4/1990 Clearman et al.
4,920,990 A 5/1990 Lawrence et al.
4,925,602 A 5/1990 Hill et al.
4,941,486 A 7/1990 Dube et al.
4,961,438 A 10/1990 Korte
4,966,171 A 10/1990 Serrano et al.
4,969,476 A 11/1990 Bale et al.
4,989,619 A 2/1991 Clearman et al.
4,991,606 A 2/1991 Serrano et al.
5,004,579 A 4/1991 Wislinski et al.
5,012,823 A 5/1991 Keritsis et al.
5,012,828 A 5/1991 Hayes et al.
5,012,829 A 5/1991 Thesing et al.
5,020,548 A 6/1991 Farrier et al.
5,025,814 A 6/1991 Raker
5,027,836 A 7/1991 Shannon et al.
5,027,837 A 7/1991 Clearman et al.
5,033,483 A 7/1991 Clearman et al.
5,040,551 A 8/1991 Schlatter et al.
5,050,621 A 9/1991 Creighton et al.
5,052,413 A 10/1991 Baker et al.
5,060,664 A 10/1991 Siems et al.
5,060,665 A 10/1991 Heitmann
5,065,776 A 11/1991 Lawson et al.
5,067,500 A 11/1991 Keritsis
5,074,320 A 12/1991 Jones, Jr. et al.
5,076,296 A 12/1991 Nystrom et al.
5,076,297 A 12/1991 Farrier et al.
5,099,861 A 3/1992 Clearman et al.
5,101,839 A 4/1992 Jakob et al.
5,105,837 A 4/1992 Barnes et al.
5,105,838 A 4/1992 White et al.
5,115,820 A 5/1992 Hauser et al.
5,131,416 A 7/1992 Gentry
5,137,034 A 8/1992 Perfetti et al.
5,148,821 A 9/1992 Best et al.
5,156,169 A 10/1992 Holmes et al.

(56) References Cited

U.S. PATENT DOCUMENTS 5,159,940 A 11/1992 Hayward et al.
5,159,944 A 11/1992 Arzonico et al.
5,178,167 A 1/1993 Riggs et al.
5,183,062 A 2/1993 Clearman et al.
5,191,906 A 3/1993 Myracle, Jr.
5,211,684 A 5/1993 Shannon et al.
5,220,930 A 6/1993 Gentry
5,225,277 A 7/1993 Takegawa et al.
5,240,014 A 8/1993 Deevi et al.
5,240,016 A 8/1993 Nichols et al.
5,246,017 A 9/1993 Saintsing et al.
5,271,419 A 12/1993 Arzonico et al.
5,323,791 A * 6/1994 Wu et al. ..... 131/369
5,331,981 A 7/1994 Tamaoki et al.
5,345,955 A 9/1994 Clearman et al.
5,360,023 A 11/1994 Blakley et al.
5,387,285 A 2/1995 Rivers
5,396,909 A 3/1995 Gentry et al.
5,396,911 A 3/1995 Casey, III et al.
5,404,890 A 4/1995 Gentry et al.
5,474,092 A 12/1995 Moser et al. ..... 131/280
5,476,108 A 12/1995 Dominguez et al.
5,551,451 A 9/1996 Riggs et al.
5,568,819 A 10/1996 Gentry et al.
5,595,577 A 1/1997 Bensalem et al.
5,613,504 A 3/1997 Collins et al.
5,622,190 A 4/1997 Arterbery et al.
5,709,352 A 1/1998 Rogers et al.
5,718,250 A 2/1998 Banerjee et al.
5,724,997 A 3/1998 Smith et al.
5,727,571 A 3/1998 Meiring et al.
5,819,751 A 10/1998 Barnes et al.
5,855,826 A 1/1999 Lee et al.
5,855,862 A 1/1999 Grenier et al.
6,041,790 A 3/2000 Smith et al.
6,089,857 A 7/2000 Matsuura et al.
6,095,152 A 8/2000 Beven et al.
6,229,115 B1 5/2001 Voss et al.
6,325,859 B1 12/2001 De Roos et al.
6,336,896 B1 1/2002 Hsu et al.
6,360,751 B1 3/2002 Fagg et al.
6,384,359 B1 5/2002 Belcastro et al.
6,385,333 B1 5/2002 Puckett et al.
6,417,156 B1 7/2002 Smith et al.
6,452,404 B2 9/2002 Moeller et al.
6,537,186 B1 3/2003 Veluz
6,578,584 B1 6/2003 Beven et al.
6,584,979 B2 7/2003 Xue et al.
6,595,218 B1 7/2003 Koller et al.
6,631,722 B2 10/2003 MacAdam et al.
6,647,870 B2 11/2003 Kohno
6,723,033 B1 4/2004 Scott et al.
6,761,174 B2 7/2004 Jupe et al.
6,779,530 B2 8/2004 Kraker
6,789,547 B1 9/2004 Paine, III
6,789,548 B2 9/2004 Bereman
6,848,449 B2 2/2005 Kitao et al.
6,904,917 B2 6/2005 Kitao et al.
7,004,896 B2 2/2006 Heitmann et al. ..... 493/39
7,032,445 B2 4/2006 Belcastro et al.
7,049,382 B2 5/2006 Haftka et al.
7,074,170 B2 7/2006 Lanier, Jr. et al.
7,079,912 B2 7/2006 Stack et al.
7,093,625 B2 8/2006 Smith et al.
7,115,085 B2 10/2006 Deal
7,210,486 B2 5/2007 Hartmann
7,234,471 B2 6/2007 Fitzgerald et al.
7,237,559 B2 7/2007 Ashcraft et al.
7,240,678 B2 7/2007 Crooks et al.
7,275,548 B2 10/2007 Hancock et al.
7,281,540 B2 10/2007 Barnes et al.
7,296,578 B2 11/2007 Read, Jr.
7,370,657 B2 5/2008 Zihuang et al.
7,381,175 B2 6/2008 Dawson et al.
7,434,585 B2 10/2008 Holmes
7,479,098 B2 1/2009 Thomas et al.
7,565,818 B2 7/2009 Thomas et al.
7,578,298 B2 8/2009 Karles et al.
7,757,835 B2 7/2010 Garthaffner et al.
8,186,359 B2 5/2012 Ademe et al.
2002/0020420 A1 2/2002 Xue et al.
2002/0166563 A1 11/2002 Jupe et al.
2003/0015493 A1 1/2003 Grasshoff et al.
2003/0034085 A1 2/2003 Spiers et al.
2003/0038144 A1 2/2003 Gertitschke et al. ..... 221/266
2003/0098033 A1 5/2003 Macadam et al.
2003/0136419 A1 7/2003 Muller
2003/0137312 A1 7/2003 Cerati et al.
2003/0145866 A1 8/2003 Hartmann
2003/0168070 A1 9/2003 Xue et al.
2003/0178036 A1 9/2003 Demmer et al.
2003/0200973 A1 10/2003 Xue et al.
2004/0129281 A1 7/2004 Hancock et al.
2004/0139977 A1 7/2004 Garthaffner
2004/0194792 A1 10/2004 Zhuang et al.
2004/0226569 A1 11/2004 Yang et al.
2004/0237984 A1 12/2004 Figlar et al.
2004/0250824 A1 12/2004 Gosebruch
2004/0261807 A1 12/2004 Dube et al.
2005/0016556 A1 1/2005 Ashcraft et al.
2005/0039764 A1 2/2005 Barnes et al.
2005/0049128 A1 3/2005 Buhl et al.
2005/0066981 A1 3/2005 Crooks et al.
2005/0066984 A1 3/2005 Crooks et al.
2005/0066986 A1 3/2005 Nestor et al.
2005/0070409 A1 3/2005 Deal
2005/0076929 A1 4/2005 Fitzgerald et al.
2005/0133051 A1 6/2005 Luan et al.
2005/0268925 A1 12/2005 Schluter et al.
2006/0090769 A1 5/2006 Woodson et al.
2006/0096605 A1 5/2006 Karles et al.
2006/0112963 A1 6/2006 Scott et al.
2006/0112964 A1 6/2006 Jupe et al.
2006/0124143 A1 6/2006 Sherron et al.
2006/0130861 A1 6/2006 Luan et al.
2006/0135335 A1 6/2006 Dawson et al.
2006/0144410 A1 7/2006 Luan et al.
2006/0144412 A1 7/2006 Mishra et al.
2006/0174899 A9 8/2006 Luan et al.
2006/0174901 A1 8/2006 Karles et al.
2006/0180164 A1 8/2006 Paine, III et al.
2006/0196513 A1 9/2006 Atwell et al.
2006/0207616 A1 9/2006 Hapke et al.
2006/0264130 A1 11/2006 Karles et al.
2006/0272655 A1 12/2006 Thomas et al.
2006/0272662 A1 12/2006 Jupe et al.
2006/0272663 A1 12/2006 Dube et al.
2006/0278543 A1 12/2006 Pham
2006/0278642 A1 12/2006 Pugne et al.
2006/0281614 A1 12/2006 Scott et al.
2006/0293157 A1 12/2006 Deal
2007/0000505 A1 1/2007 Zhuang et al.
2007/0012327 A1 1/2007 Karles et al.
2007/0023058 A1 2/2007 Howell et al.
2007/0023301 A1 2/2007 Pham
2007/0056600 A1 3/2007 Coleman, III et al.
2007/0068540 A1 3/2007 Thomas et al.
2007/0084476 A1 4/2007 Yang et al.
2007/0095357 A1 5/2007 Besso et al.
2007/0215167 A1 9/2007 Llewellyn Crooks et al.
2007/0246055 A1 10/2007 Oglesby
2007/0284012 A1 12/2007 Smith et al.
2008/0017206 A1 1/2008 Becker et al.
2008/0029111 A1 2/2008 Dube et al.
2008/0029118 A1 2/2008 Nelson et al.
2008/0092912 A1 4/2008 Robinson et al.
2008/0156336 A1 7/2008 Wyss-Peters et al.
2008/0163877 A1 7/2008 Zhuang et al.
2008/0190439 A1 8/2008 Veluz et al.
2008/0230079 A1 9/2008 Besso et al.
2008/0286408 A1 11/2008 Karles et al.
2008/0302373 A1* 12/2008 Stokes et al. ..... 131/84.1
2009/0004337 A1 1/2009 Liu et al.
2009/0038628 A1 2/2009 Shen et al.

(56) References Cited

U.S. PATENT DOCUMENTS

| | | | |
|---|---|---|---|
| 2009/0039102 | A1 | 2/2009 | Garthaffner et al. |
| 2009/0120449 | A1 | 5/2009 | Tindall |
| 2009/0145724 | A1 | 6/2009 | Garthaffner et al. |
| 2009/0151738 | A1 | 6/2009 | Robertson et al. |
| 2009/0166376 | A1 | 7/2009 | Garthaffner et al. |
| 2009/0277465 | A1 | 11/2009 | Karles et al. |
| 2010/0184576 | A1 | 7/2010 | Prestia et al. |

FOREIGN PATENT DOCUMENTS

| | | | |
|---|---|---|---|
| DE | 23 28 457 | | 12/1973 |
| DE | 10 2006 025738 | B3 | 11/2007 |
| EP | 0 236 922 | A2 | 9/1987 |
| EP | 0 295 518 | | 12/1988 |
| EP | 0 330 709 | A1 | 9/1989 |
| EP | 0 419 733 | A2 | 4/1991 |
| EP | 0 419 981 | A2 | 4/1991 |
| EP | 0 457 587 | A2 | 5/1991 |
| EP | 0 579 410 | A1 | 1/1994 |
| EP | 0 987 276 | A1 | 3/2000 |
| EP | 1 013 180 | A1 | 6/2000 |
| EP | 1 167 589 | A1 | 1/2002 |
| FR | 2 103 346 | A5 | 4/1972 |
| GB | 662497 | A | 12/1951 |
| GB | 1132950 | | 11/1968 |
| GB | 1 585 761 | | 6/1976 |
| GB | 1 585 761 | A | 3/1981 |
| GB | 2 223 393 | A | 4/1990 |
| GB | 2 284 138 | A | 5/1995 |
| JP | 54-147983 | A | 10/1979 |
| JP | 59-38794 | A | 3/1984 |
| JP | 07-206141 | A | 8/1995 |
| JP | 08-322538 | A | 12/1996 |
| JP | 10-291928 | | 11/1998 |
| JP | 11-90262 | A | 7/2001 |
| KR | 1999-0031274 | | 5/1999 |
| KR | 2000-0052283 | | 8/2000 |
| WO | WO 86/04488 | | 8/1986 |
| WO | WO 98/49912 | A1 | 11/1998 |
| WO | WO 99/26496 | A2 | 6/1999 |
| WO | WO 01/41590 | A1 | 6/2001 |
| WO | WO 02/03819 | | 1/2002 |
| WO | WO 02/076246 | A2 | 10/2002 |
| WO | WO 03/009711 | | 2/2003 |
| WO | WO 03/015544 | A1 | 2/2003 |
| WO | WO 03/016137 | | 2/2003 |
| WO | WO 03/034847 | A1 | 5/2003 |
| WO | WO 03/034848 | A1 | 5/2003 |
| WO | WO 03/039276 | | 5/2003 |
| WO | WO 03/047836 | | 6/2003 |
| WO | WO 03/051144 | A1 | 6/2003 |
| WO | WO 03/092416 | A1 | 11/2003 |
| WO | WO 2004/014161 | A1 | 2/2004 |
| WO | WO 2004/095957 | A2 | 11/2004 |
| WO | WO 2005/023026 | A1 | 3/2005 |
| WO | WO 2005/082180 | A2 | 9/2005 |
| WO | WO 2005/112670 | A1 | 12/2005 |
| WO | WO 2005/118133 | A2 | 12/2005 |
| WO | WO 2006/000918 | A2 | 1/2006 |
| WO | WO 2006/051422 | A1 | 5/2006 |
| WO | WO 2006/059134 | A1 | 6/2006 |
| WO | WO 2006/064371 | A1 | 6/2006 |
| WO | WO 2006/092962 | A1 | 9/2006 |
| WO | WO 2006/103404 | A1 | 10/2006 |
| WO | WO 2006/136197 | A1 | 12/2006 |
| WO | WO 2006/136199 | A1 | 12/2006 |
| WO | WO 2006/136950 | A1 | 12/2006 |
| WO | WO 2007/010249 | A1 | 1/2007 |
| WO | WO 2007/010407 | A2 | 1/2007 |
| WO | WO 2007/026131 | A1 | 3/2007 |
| WO | WO 2007/028957 | A1 | 3/2007 |
| WO | WO 2007/060543 | A2 | 5/2007 |
| WO | WO 2007/085830 | A2 | 8/2007 |
| WO | WO 2007/093757 | A1 | 8/2007 |
| WO | WO 2007/104908 | A1 | 9/2007 |
| WO | WO 2008/081329 | A2 | 7/2008 |
| WO | WO 2008/084333 | A2 | 7/2008 |
| WO | WO 2008/146162 | A1 | 12/2008 |
| WO | WO 2008/146169 | A2 | 12/2008 |
| WO | WO 2009/016513 | A2 | 2/2009 |

OTHER PUBLICATIONS

International Search Report for International application No. PCT/US04/19113, dated Apr. 27, 2005.

Written Opinion of the International Searching Authority for International application No. PCT/US04/19113, dated Apr. 27, 2005.

International Search Report for International Application No. PCT/US2006/036313, dated Jan. 19, 2007.

Written Opinion of the International Searching Authority for International Application No. PCT/US2006/036313, dated Jan. 19, 2007.

Transaction History from Patent Application Information Retrieval for co-pending U.S. Appl. No. 11/499,154, including each substantive office action and applicant response.

Transaction History from Patent Application Information Retrieval for co-pending U.S. Appl. No. 10/661,807, now U.S. Patent No. 7,115,085, including each substantive office action and applicant response.

Transaction History from Patent Application Information Retrieval for U.S. Appl. No. 11/234,834, now U.S. Patent No. 7,479,098, including each substantive office action and applicant response.

Reference A 5572 t—Observations concerning the patentability of European Patent Application No. 06803792.8 according to Art. 115 EPC (16p).

Search Report from European Patent Application No. 04782295.2, dated Nov. 23, 2011, 5 p.

EP Office Action Intention to Grant for EP Application No. 06 803 792.8-1656 dated Apr. 11, 2013, (8p).

* cited by examiner

Fig. 4
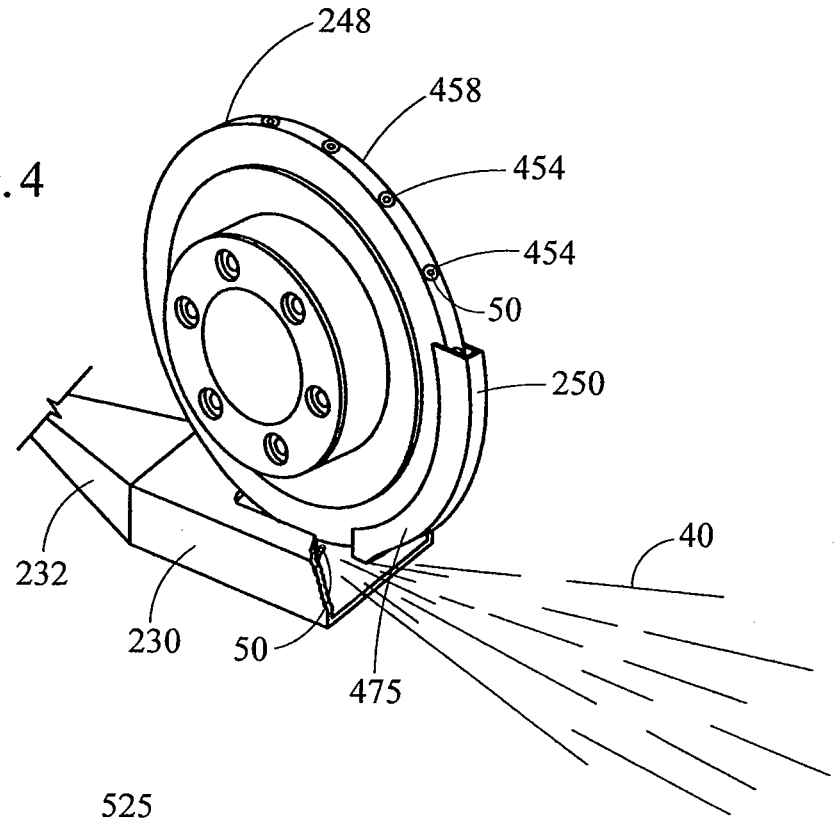
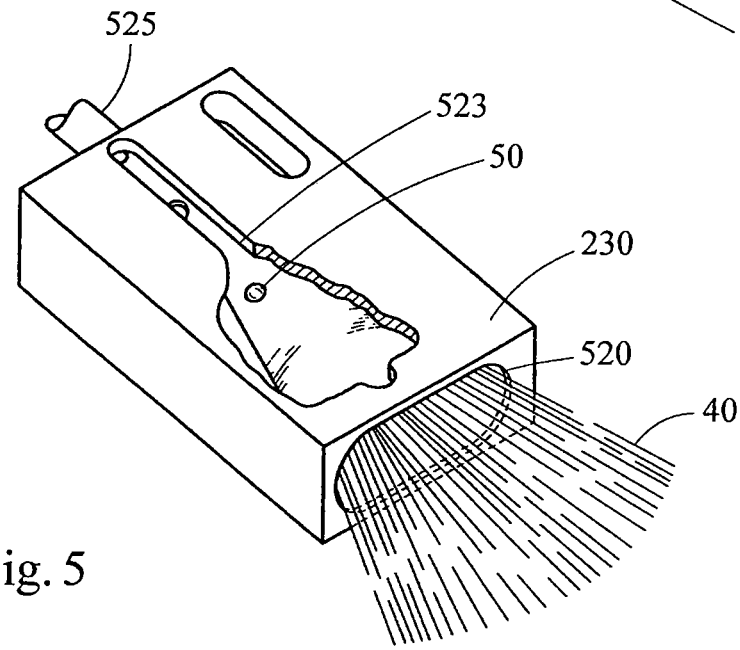
Fig. 5

EQUIPMENT FOR INSERTION OF OBJECTS INTO SMOKING ARTICLES

This application is a divisional of U.S. patent application Ser. No. 11/234,834, filed Sep. 23, 2005, now U.S. Pat. No. 7,479,098, the disclosure of which is incorporated herein by reference.

FIELD OF THE INVENTION

The present invention relates to apparatus and methods for manufacturing smoking articles and components of smoking articles, such as filter elements. In particular, the present invention relates to apparatus for inserting objects into a filter component for use in the manufacture of a filter element for a smoking article, such as a cigarette.

BACKGROUND OF THE INVENTION

Popular smoking articles, such as cigarettes, have a substantially cylindrical rod shaped structure and include a charge, roll or column of smokable material such as shredded tobacco (e.g., in cut filler form) surrounded by a paper wrapper thereby forming a so-called "smokable rod" or "tobacco rod." Normally, a cigarette has a cylindrical filter element aligned in an end-to-end relationship with the tobacco rod. Typically, a filter element comprises cellulose acetate tow plasticized using triacetin, and the tow is circumscribed by a paper material known as "plug wrap." A cigarette can incorporate a filter element having multiple segments, and one of those segments can comprise activated charcoal particles. Typically, the filter element is attached to one end of the tobacco rod using a circumscribing wrapping material known as "tipping paper." It also has become desirable to perforate the tipping material and plug wrap, in order to provide dilution of drawn mainstream smoke with ambient air. Descriptions of cigarettes and the various components thereof are set forth *Tobacco Production, Chemistry and Technology*, Davis et al. (Eds.) (1999). A cigarette is employed by a smoker by lighting one end thereof and burning the tobacco rod. The smoker then receives mainstream smoke into his/her mouth by drawing on the opposite end (e.g., the filter end) of the cigarette.

The sensory attributes of cigarette smoke can be enhanced by applying additives to tobacco and/or by otherwise incorporating flavoring materials into various components of a cigarette. See, Leffingwell et al., *Tobacco Flavoring for Smoking Products*, R.J. Reynolds Tobacco Company (1972). For example, one type of tobacco flavoring additive is menthol. See, Borschke, *Rec. Adv. Tob. Sci.,* 19, p. 47-70, 1993. Various proposed methods for modifying the sensory attributes of cigarettes have involved suggestion that filter elements may be used as vehicles for adding flavor to the mainstream smoke of those cigarettes. US Pat. Appl. Pub. No. 2002/0166563 to Jupe et al. proposes the placement of adsorbent and flavor-releasing materials in a cigarette filter. US Pat. Appl. Pub. No. 2002/0020420 to Xue et al. proposes the placement of fibers containing small particle size adsorbents/absorbents in the filter. U.S. Pat. No. 4,941,486 to Dube et al. and U.S. Pat. No. 4,862,905 to Green, Jr. et al. propose the placement of a flavor-containing pellet in a cigarette filter. Other representative types of cigarette filters incorporating flavoring agents are set forth in U.S. Pat. No. 3,972,335 to Tiggelbeck et al.; U.S. Pat. No. 4,082,098 to Owens, Jr.; U.S. Pat. No. 4,281,671 to Byrne; U.S. Pat. No. 4,729,391 to Woods et al.; and U.S. Pat. No. 5,012,829 to Thesing et al.

Cigarettes having adjustable filter elements that allow smokers to select the level of flavor that is available for transfer into mainstream smoke have been proposed. See, for example, U.S. Pat. No. 4,677,995 to Kallianos et al. and U.S. Pat. No. 4,848,375 to Patron et al. Some proposed cigarettes may be manipulated, reportedly for the purpose of providing components of their filter elements with the propensity to modify the nature or character of mainstream smoke. See, for example, U.S. Pat. No. 3,297,038 to Homburger; U.S. Pat. No. 3,339,557 to Karalus; U.S. Pat. No. 3,420,242 to Boukar; U.S. Pat. No. 3,508,558 to Seybum; U.S. Pat. No. 3,513,859 to Carty; U.S. Pat. No. 3,596,665 to Kindgard; U.S. Pat. No. 3,669,128 to Cohen; and U.S. Pat. No. 4,126,141 to Grossman.

Some proposed cigarettes have hollow objects positioned in their filter elements, and the contents of those objects reportedly are released into the filter elements upon rupture of those objects in the attempt to alter the nature or character of the mainstream smoke passing through those filter elements. See, for example, U.S. Pat. No. 3,339,558 to Waterbury; U.S. Pat. No. 3,366,121 to Carty; U.S. Pat. No. 3,390,686 to Irby, Jr. et al.; U.S. Pat. No. 3,428,049 to Leake; U.S. Pat. No. 3,547,130 to Harlow et al. U.S. Pat. No. 3,575,1809 to Carty; U.S. Pat. No. 3,602,231 to Dock; U.S. Pat. No. 3,625,228 to Dock; U.S. Pat. No. 3,635,226 to Horsewell et al.; U.S. Pat. No. 3,685,521 to Dock; U.S. Pat. No. 3,916,914 to Brooks et al.; U.S. Pat. No. 3,991,773 to Walker; and U.S. Pat. No. 4,889,144 to Tateno et al.; US Pat. Application Pub. Nos. 2004/0261807 to Dube et al; and 2005/0070409 to Deal; and PCT WO 03/009711 to Kim. Some proposed cigarettes have capsules positioned in their filter elements, and the contents of those capsules reportedly are released into the filter elements upon rupture of those capsules in order to deodorize the filter element after the cigarette is extinguished. See, for example, US Pat. Appl. Pub. No. 2003/0098033 to MacAdam et al.

Commercially marketed "Rivage" brand cigarettes have included a filter possessing a cylindrical plastic container containing water or a liquid flavor solution. Cigarettes representative of the "Rivage" brand cigarettes are described in U.S. Pat. No. 4,865,056 to Tamaoki et al. and U.S. Pat. No. 5,331,981 to Tamaoki et al., both of which are assigned to Japan Tobacco, Inc. The cylindrical casing within the filter reportedly may be deformed upon the application of external force, and a thin wall portion of the casing is consequently broken so as to permit release of the liquid within the casing into an adjacent portion of that filter.

A cigarette holder has been available under the brand name "Aquafilter." Cigarette holders representative of the "Aquafilter" brand product are described in U.S. Pat. No. 3,797,644 to Shaw; U.S. Pat. No. 4,003,387 to Goldstein; and U.S. Pat. No. 4,046,153 to Kaye; assigned to Aquafilter Corporation. Those patents propose a disposable cigarette holder into which the mouth end of a cigarette is inserted. Smoke from the cigarette that is drawn through the holder reportedly passes through filter material impregnated with water. A disposable filter adapted to be attachable to the mouth end of a cigarette has been proposed in U.S. Pat. No. 5,724,997 to Smith et al. Flavor-containing capsules contained within the disposable filter reportedly may be squeezed in order to release the flavor within those capsules.

Some smokers might desire a cigarette that is capable of selectively providing a variety of different flavors, depending upon the smoker's immediate desire. The flavor of such a cigarette might be selected based on the smoker's desire for a particular flavor at that time, or a desire to change flavors during the smoking experience. For example, changing flavors during the smoking experience may enable a smoker to end the cigarette with a breath freshening flavor, such as menthol or spearmint. Accordingly, it would be desirable to provide a cigarette that is capable of providing distinctive, different pleasurable sensory experiences, at the discretion of a smoker.

Some smokers might also desire a cigarette that is capable of selectively releasing a deodorizing agent upon completion of a smoking experience. Such agents may be used to ensure that the remaining portion of a smoked cigarette yields a pleasant aroma after the smoker has finished smoking that cigarette. Accordingly, it is desirable to provide a cigarette that is capable of releasing a deodorizing agent, particularly at the discretion of the smoker.

Some smokers might desire a cigarette that is capable of selectively moistening, cooling, or otherwise modifying the nature or character of the mainstream smoke generated by that cigarette. Because certain agents that can be used to interact with smoke are volatile and have the propensity to evaporate over time, the effects of those agents upon the behavior of those cigarettes may require introduction of those agents near commencement of the smoking experience. Accordingly, is desirable to provide a cigarette that is capable of selectively moistening, smoothing or cooling the smoke delivered to a smoker, at the discretion of that smoker.

It would be highly desirable to provide a smoker with the ability to enhance his/her smoking experience, such as can be accomplished by allowing the smoker to purposefully select certain characteristics or behaviors that the cigarette exhibits. That is, it would be desirable to provide a cigarette possessing components that can be employed so as to allow the smoker to alter, in a controlled way, the nature or character of the mainstream smoke produced by that cigarette. In particular, it would be desirable to provide a cigarette that is capable of selectively releasing an agent for enhancing the sensory attributes of the mainstream smoke (e.g., by flavoring that smoke). More particularly, it would be desirable to provide the means to manufacture such cigarettes incorporating such selectively-releasable flavor agents and the like in a rapid, highly-automated fashion. It also would be desirable to provide improved means to incorporate smoke-altering solid objects such as flavor pellets, exchange resin beads and adsorbent/absorbent particles into cigarette filters, in a rapid, highly automated fashion.

SUMMARY OF THE INVENTION

The present invention relates to an apparatus and process for providing filter rods for use in the manufacture of smoking articles, and each rod has objects (e.g., rupturable capsules) individually spaced at predetermined intervals along its length. The apparatus incorporates equipment for supplying a continuous supply of filter material (e.g., a filter tow processing unit adapted to supply filter tow to a continuous rod forming unit). A representative apparatus also includes an upper hopper that acts as a reservoir for a plurality of objects, and provides for supply of objects to a lower hopper. Passage of objects from the upper hopper to the lower hopper is promoted by vibrating the objects contained in the upper hopper, as well as by employing a movable screening mechanism (e.g., a reciprocating bar possessing vertically extending passageways for object transport). The lower hopper is shaped so that objects are stacked therein. The objects in the lower hopper are stacked on top of one another, but at a depth (when viewed looking toward the hopper) of a single layer of objects. The bottom of the lower hopper is shaped so as to cooperate with a portion of upper region of a rotating wheel that is positioned so as to rotate in a vertical plane, and the objects are fed from the lower hopper onto the peripheral face of that rotating wheel. That is, objects within the lower hopper are aligned in a single line along a portion of the peripheral face in the upper region of the rotating wheel.

The peripheral face of the rotating wheel incorporates a plurality of spaced pockets, each pocket being of sufficient shape and size to accommodate one object. Individual objects are placed into individual pockets located at pre-determined intervals on the peripheral face of the rotating wheel. Vacuum applied to each pocket acts to assist in ensuring that each pocket accepts an object, and that each object within a pocket is maintained in that pocket during transport. Each object then is positioned at predetermined intervals within a continuous supply of filter material. Air pressure applied to each pocket acts to blow that object out of the pocket at the desired time (e.g., when the object carried by the rotating wheel is located at the desired location within the continuous supply of filter material. Then, the filter material is formed into a continuous rod having individual objects positioned at predetermined spaced intervals within that rod. The continuous rod then is subdivided at predetermined intervals so as to form a plurality of filter rods (e.g., four-up filter rods containing four spaced objects).

BRIEF DESCRIPTION OF THE DRAWINGS

In order to assist the understanding of embodiments of the invention, reference will now be made to the appended drawings, in which like reference numerals refer to like elements. The drawings are exemplary only, and should not be construed as limiting the invention.

FIG. 4 is a perspective of a portion of the object insertion unit showing the object insertion wheel.

FIG. 5 is a perspective of a portion of the object insertion unit showing placement of individual objects within a continuous web of filter tow.

DETAILED DESCRIPTION OF THE PREFERRED EMBODIMENTS

The production of filter rods, filter rod segments and filter elements, and the manufacture of cigarettes from those filter rods, filter rod segments and filter elements can be carried out using the types of rod-forming units that have been employed to provide cigarette filters, multi-segment cigarette filters and filtered cigarettes. Multi-segment cigarette filter rods can be manufactured using a cigarette filter rod making device available under the brand name Mulfi from Hauni-Werke Korber & Co. KG of Hamburg, Germany. Other representative types of commercially available filter rod making equipment that can suitably modified for use include the KDF-2 unit available from Hauni-Werke Korber & Co. KG and the Decoufle unit available from Decoufle of France.

Figure 11:
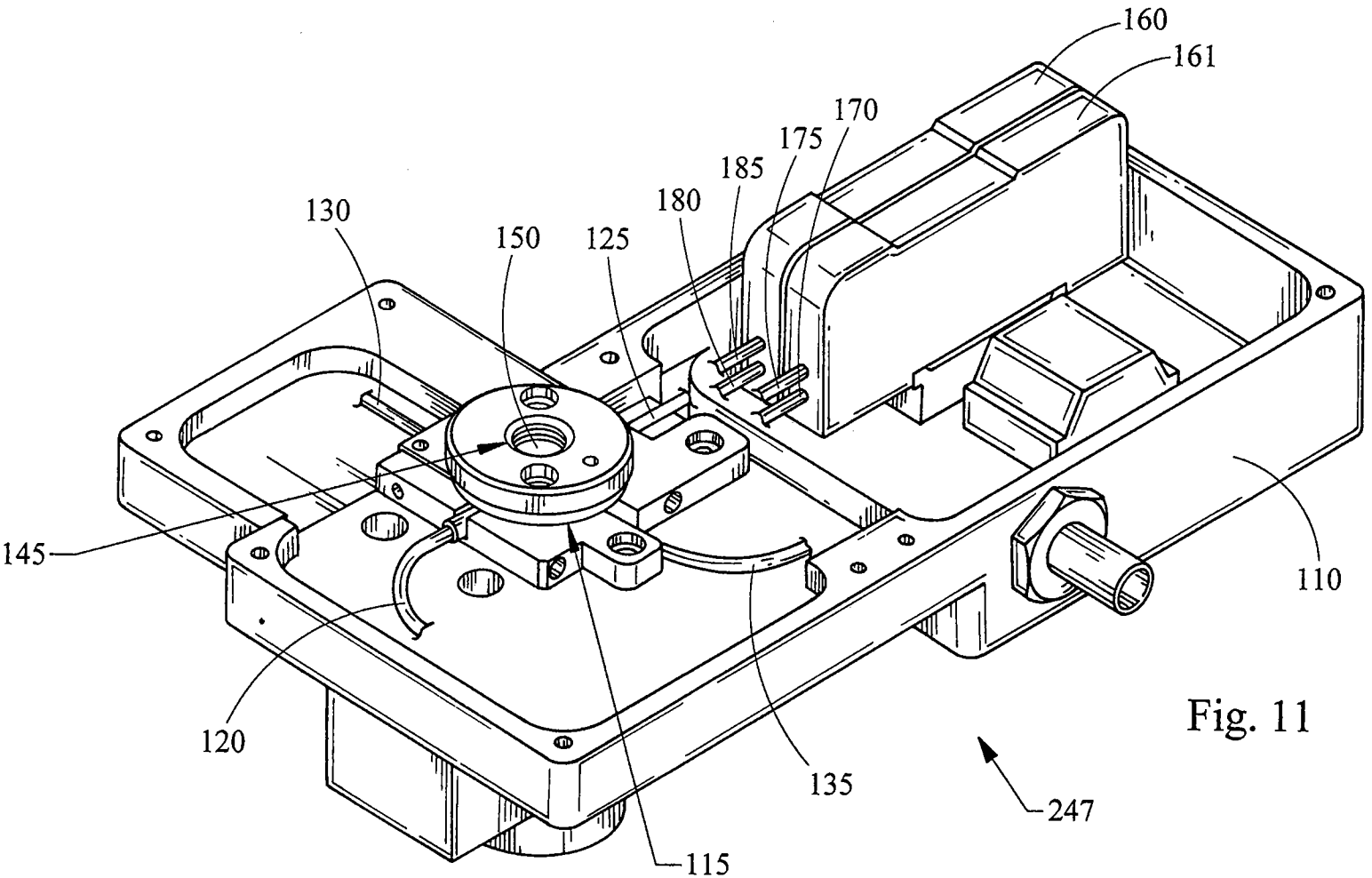
FIG. 11 is a perspective view of one embodiment of an object detection unit.

Cigarettes made by the apparatus of the present invention are manufactured using filter elements provided from filter rods. Six-up filter rods, four-up filter rods and two-up filter rods that are conventionally used for the manufacture of filtered cigarettes can be handled using conventional-type or suitably modified cigarette rod handling devices, such as tipping devices available as Lab MAX, MAX, MAX S or MAX 80 from Hauni-Werke Korber & Co. KG. See, for example, the types of devices set forth in U.S. Pat. No. 3,308,600 to Erdmann et al.; U.S. Pat. No. 4,281,670 to Heitmann et al.; U.S. Pat. No. 4,280,187 to Reuland et al.; and U.S. Pat. No. 6,229,115 to Vos et al. For example, a four-up filter rod is subdivided into four cylindrical shaped filter elements (as shown in FIG. 11). Descriptions of representative types of four-up filter rods having spaced objects nested in, embedded in, or surrounded by, cellulose acetate filter tow are set forth in US Pat. Applic. Pub. No. 2005/0070409 A1, to Deal and U.S. Pat. No. 4,862,905 to Green, Jr. et al.; which are incorporated herein by reference in their entireties. Rod sizes for use in the manufacture of filter elements for cigarettes can vary, but typically range in length from about 80 mm to about 140 mm, and from about 16 mm to about 27 mm in circumference. For example, a typical rod having a 100 mm length and a 24.53 mm circumference exhibits a pressure drop of from about 200 mm to about 400 mm of water as determined at an airflow rate of 17.5 cc/sec. using an encapsulated pressure drop tester, sold commercially as Model No. FTS-300 by Filtrona Corporation, Richmond, Va.

Representative types of filter rods incorporating objects, and representative types of cigarettes possessing filter elements incorporating objects, such as flavor-containing capsules, can possess the types of components, format and configuration, and can be manufactured using the types of techniques and equipment set forth in US Pat. Applic. Pub. Nos. 2004/0261807 to Dube et al. and 2005/0070409 A1 to Deal; which are incorporated herein by reference in their entireties. Cigarettes made by the apparatus of the present invention also can be manufactured using filter elements provided from filter rods that are produced using the types of techniques and equipment described hereinafter with reference to FIG. 1 through FIG. 7 and FIGS. 11 and 12.

Figure 1:
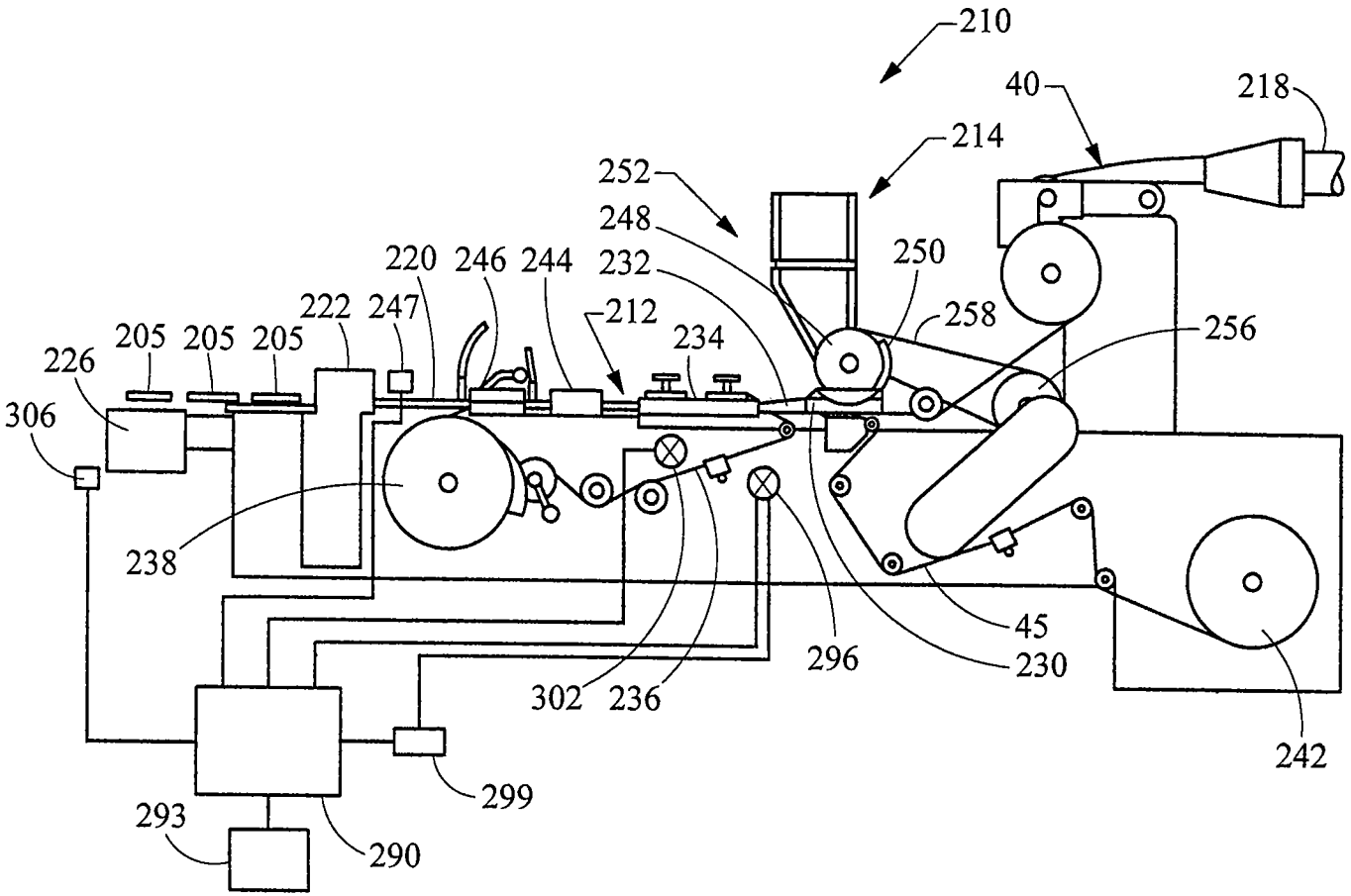
FIG. 1 is a diagrammatic illustration a rod-making apparatus including a portion of the filter tow processing unit, a source of objects, an object insertion unit, and a filter rod-forming unit.

Referring to FIG. 1, filter rods 205 incorporating spaced objects (shown in FIG. 8), such as spherical objects, can be manufactured using a rod-making apparatus 210. An exemplary rod-making apparatus 210 includes a rod-forming unit 212 (e.g., a KDF-2 unit available from Hauni-Werke Korber & Co. KG) and an object insertion unit 214 suitably adapted to provide for placement of spherical objects (not shown) at predetermined intervals within a continuous length of filter material 40. The continuous length or web of filter material is supplied from a source (not shown) such as a storage bale, bobbin, or the like. Generally, the filter material 40 is processed using a filter material processing unit 218. The continuous length of filter material which has objects incorporated therein at predetermined, spaced intervals is passed through the rod-forming unit 212 thereby forming a continuous rod 220, which can be subdivided using a rod cutting assembly 222 into a plurality of rods 205. The succession or plurality of rods 205 are collected for use in collection means 226 which is a tray, a rotary collection drum, conveying system, or the like. If desired, the rods can be transported directly to a cigarette making machine. In such a manner, in excess of 500 rods, each of about 100 mm length, can be manufactured per minute.

The filter material 40 can vary, and can be any material of the type that can be employed for providing a tobacco smoke filter for cigarettes. Preferably a traditional cigarette filter material is used, such as cellulose acetate tow, gathered cellulose acetate web, polypropylene tow, gathered cellulose acetate web, gathered paper, strands of reconstituted tobacco, or the like. Especially preferred is filamentary tow such as cellulose acetate, polyolefins such as polypropylene, or the like. One highly preferred filter material that can provide a suitable filter rod is cellulose acetate tow having 3 denier per filament and 40,000 total denier. As another example, cellulose acetate tow having 3 denier per filament and 35,000 total denier can provide a suitable filter rod. As another example, cellulose acetate tow having 8 denier per filament and 40,000 total denier can provide a suitable filter rod. For further examples, see the types of filter materials set forth in U.S. Pat. No. 3,424,172 to Neurath; U.S. Pat. No. 4,811,745 to Cohen et al.; U.S. Pat. No. 4,925,602 to Hill et al.; U.S. Pat. No. 5,225,277 to Takegawa et al. and U.S. Pat. No. 5,271,419 to Arzonico et al.

Filamentary tow, such as cellulose acetate, is processed using a conventional filter tow processing unit 218 such as a commercially available E-60 supplied by Arjay Equipment Corp., Winston-Salem, N.C. Other types of commercially available tow processing equipment, as are known to those of ordinary skill in the art, may similarly be used. Normally a plasticizer such as triacetin is applied to the filamentary tow in traditional amounts using known techniques. Other suitable materials for construction of the filter element will be readily apparent to those skilled in the art of cigarette filter design and manufacture.

The continuous length of filter material 40 is pulled through a block 230 by the action of the rod-forming unit 212 and the individual objects (not shown) are inserted at predetermined intervals within the web of filter material. The filter material is further directed into a gathering region 232 of the rod-forming unit 212. The gathering region can have a tongue and horn configuration, a gathering funnel configuration, stuffer or transport jet configuration, or other suitable type of gathering means. The tongue 232 provides for further gathering, compaction, conversion or formation of the cylindrical composite from block 230 into an essentially cylindrical (i.e., rod-like) shape whereby the continuously extending stands or filaments of the filter material extend essentially along the longitudinal axis of the cylinder so formed.

The filter material 40, which has been compressed into a cylindrical composite, is received further into the rod-forming unit 212. The cylindrical composite is fed into wrapping mechanism 234, which includes endless garniture conveyer belt 236 or other garniture means. The garniture conveyer belt 236 is continuously and longitudinally advanced using advancing mechanism 238 such as a ribbon wheel or cooperating drum so as to transport the cylindrical composite through wrapping mechanism 234. The wrapping mechanism provides a strip of wrapping material 45 (e.g., non-porous paper plug wrap) to the outer surface of the cylindrical composite in order to produce continuous wrapped rod 220.

The strip or web of wrapping material 45 is provided from rotatable bobbin 242. The wrapping material is drawn from the bobbin, is trained over a series of guide rollers, passes under block 230, and enters the wrapping mechanism 234 of the rod-forming unit. The endless garniture conveyer belt 236 transports both the strip of wrapping material and the cylindrical composite in a longitudinally extending manner through the wrapping mechanism 234 while draping or enveloping the wrapping material about the cylindrical composite.

The seam formed by an overlapping marginal portion of wrapping material has adhesive (e.g., hot melt adhesive) applied thereto at applicator region 244 in order that the wrapping material can form a tubular container for the filter material. Alternatively, the hot melt adhesive may be applied directly upstream of the wrapping material's entry into the garniture of the wrapping mechanism 234 or block 230, as the case may be. The adhesive can be cooled using chill bar 246 in order to cause rapid setting of the adhesive. It is understood that various other sealing means and other types of adhesives can be employed in providing the continuous wrapped rod.

The continuous wrapped rod 220 passes from the sealing means and is subdivided (e.g., severed) at regular intervals at the desired, predetermined length using cutting assembly 222 which includes as a rotary cutter, a highly sharpened knife, or other suitable rod cutting or subdividing means. It is particularly desirable that the cutting assembly not flatten or otherwise adversely affect the shape of the rod. The rate at which the cutting assembly severs the continuous rod at the desired points is controlled via an adjustable mechanical gear train (not shown), or other suitable means. The rate at which the objects are inserted into the continuous web of filter material is in a direct relationship to the speed of operation of rod-making machine. The object insertion unit can be geared in a direct drive relationship to the drive assembly of the rod-making apparatus. Alternatively, the object insertion unit can have a direct drive motor synchronized with the drive assembly of the rod-forming unit and feedback controlled by coupling with the object inspection means 247 to adjust the insertion unit drive assembly should the object insertion location shift out of position.

The insertion unit 214 includes a rotatable member 248 having the shape of a wheel, which most preferably held in place within a ledger housing 250. The rotating wheel 248 is positioned so as to rotate in a vertical plane. The insertion unit also includes a hopper assembly 252 and/or other transfer means for feeding or otherwise providing transfer of objects to insertion wheel 248. The insertion wheel 248 can be driven by a pulley 256 and belt 258 coupled with the main drive assembly of the rod-making apparatus 210. Alternatively, the wheel 248 can have an independent drive motor synchronized with, or controlled by, the main drive assembly (not shown) of the rod-forming unit 212. Alternatively, the insertion wheel 248 can be driven using independent drives that are servo-controlled for synchronization. In a preferred embodiment, the servo system includes a drive and control system available as Indramat (EcoDrive 03 FGP-03VRS) operated using a motor available as Indramat MKD025B-144-KPO-KN; from Mannesmann Rexroth Corp., Charlotte, N.C. The insertion wheel rotates in a clock-wise fashion. As the insertion wheel 248 rotates, each object (not shown) held within each spaced pocket (not shown) on the peripheral face of the wheel is brought into contact with the filter material 40 within the block 230, where each object then is ejected from the pocket into the gathered filter material 40.

A typical control system includes control hardware and software. An exemplary control system 290 can incorporate a Siemens 315-2DP Processor, a Siemens FM352-5 (Booleen Processor) and a 16 input bit/16 output bit module. Such a system can utilize a system display 293, such as a Siemens MP370. A typical rod-making unit possesses internal controls whereby, for a rod of desired length, the speed of the knife of the severing unit is timed relative to the speed of continuous rod formation. A first encoder 296, by way of connection with the drive belt of the rod-making unit, and with the control unit 299 of the insertion unit, provides reference of the knife position of the cutting assembly relative to the wheel position of the insertion unit. Thus, the first encoder 296 provides a means for allowing control of the speed of rotation of the wheel of the insertion unit relative to the speed at which continuous web of filter tow passes through the rod-making unit. An exemplary first encoder is available as Heidenhain Absolute 2048.

An inspection/detection system 247 is located near the cutting assembly. The detection system, such as an infrared detection system, relays information regarding the detection of an object within the filter rod to the control system 290. Typically, the objects within the filter rod are of a contrasting shade or color to be detected by visual detection sensors in the detection system 247.

Referring to FIG. 11, a preferred inspection/detection head system 247 includes a frame 110 for containment and support of relevant components, and attachment to the appropriate position on the rod making apparatus (not shown). The system 247 also includes a sensor component 115 that can include a one pair of fiber optic heads 120, 125, and/or an optional second pair of fiber optic heads 130, 135. An exemplary inspection/detection system 247 includes a primary photo electric sensor—a Keyence amplifier FS-V21RP with fiber optics (PIR1X66U), and Fiber FU-42TZ. An optional secondary representative sensor—Banner Engineering amplifier (D10DNFPQ) with fiber optics FU-42TZ—may be used. The system incorporates a sensor window region 145 that includes, for example, a high tempered glass insert and O-rings to provide isolation of the fiber optic heads from the continuous filter rod (not shown) that passes through opening 150. The diameter of the opening 150 typically is sufficient to allow the continuous filter rod (not shown) to pass readily therethrough. The paired fiber optic heads, 120 and 125, and 130 and 135, are appropriately connected to a pair of amplifiers 160, 161 inclusive at positions, 185 and 180, 175 and 170, inclusively. Portions of those cables are shown as cut away.

Figure 12:
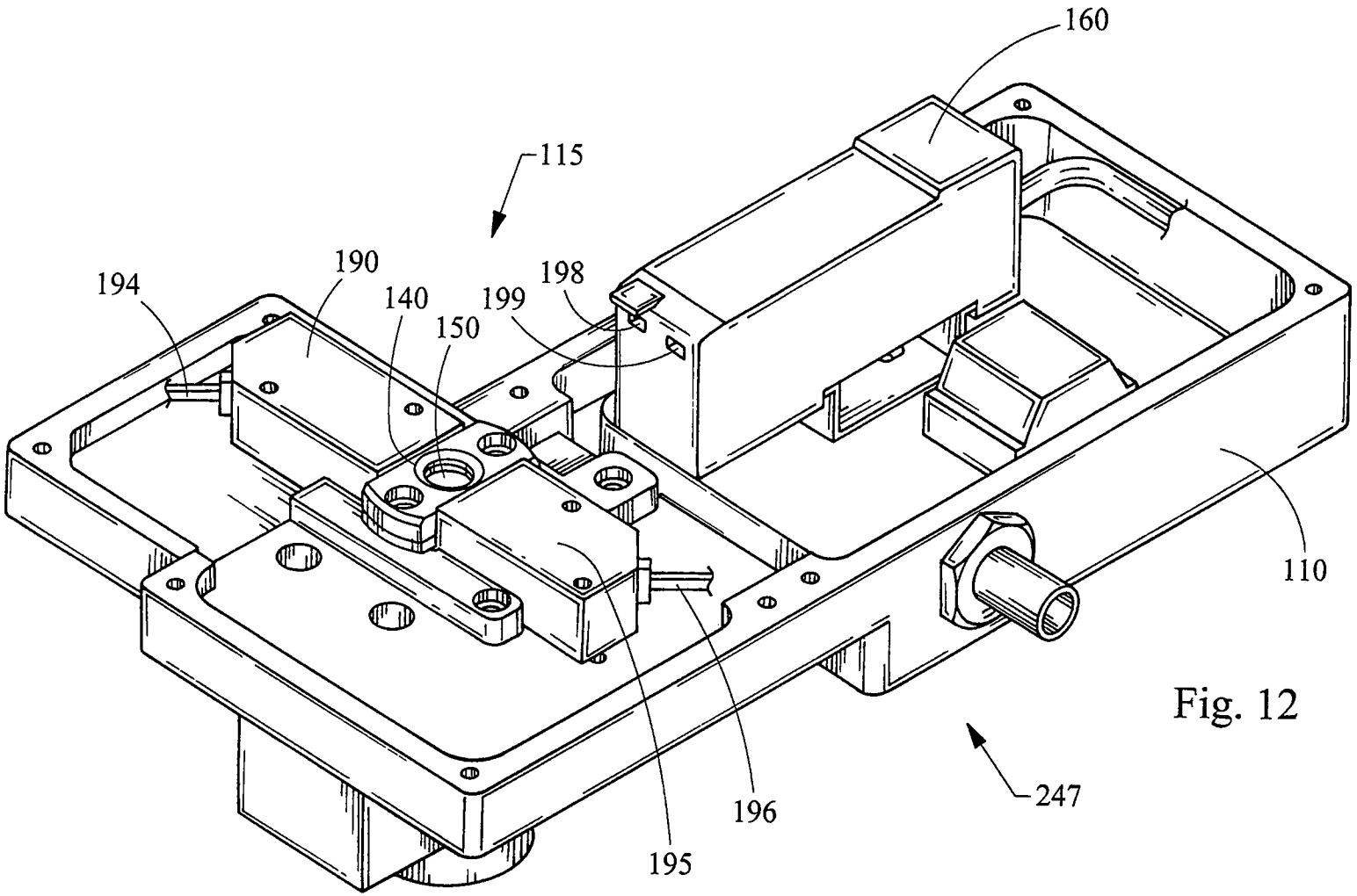
FIG. 12 is a perspective view of another embodiment of an object detection unit.

Referring to FIG. 12, another alternative design for a detection head system 247 also includes a frame 110 supporting a sensor component 115 that includes a signal sending component 190 and a receiver component 195. A representative sensor component is a laser signal type sending/receiving unit available as Keyence LV-H110. The system incorporates a sensor region 140 that allows the continuous filter rod (not shown) to pass through opening 150. The sending component 190 and receiver component 195 each are suitably connected at ports 198, 199 of an amplifier 160, such as Keyence LV-51MP, using cables 194, 196, respectively. Portions of cables 194, 196 are shown as cut away.

Referring again to FIG. 1, a second encoder 302 provides reference of the knife position of the severing unit relative to each rod that is cut from the continuous rod, and hence the information regarding the location of each rod is relayed to the Siemens FM352-5 (Booleen Processor) of the control system 290. The information provided also provides information so that the location of cut of the continuous filter rod can be timed to the location of objects within the rod. The FM352-5 receives the signals with respect to the positioning of the objects. The signal is supplied via measurement head of the inspection/detection system 247. The FM352-5 operating software compares the received signals and compares the location to the preset desired locations and undesirable locations and if errors are detected individual filters are rejected at a defined delay down stream. When the absence or mislocation of an object in the filter rod is detected, a signal is sent from the Siemens FM352-5 (Booleen Processor) by way of the aforementioned Siemens 315-2DP Processor to the rejection unit 306 of the filter rod-making machine (e.g., a traditional blow out port of a conventional filter drum). Hence, the various filter rods so provided (e.g., four-up filter rods) have the appropriate number of objects (e.g., four objects) appropriately positioned within those rods. As such, the rate of supply of web of filter material 40 and the rate of rotation of the wheel 248 of the object insertion unit 214 can be controlled such that the objects are consistently at the desired, predetermined intervals within the filter material of collected filter rods 205.

The rod-making apparatus optionally can be equipped with a system adapted to provide information associated with filter rod production and operation event analysis. For example, a rod-making apparatus, such as a commercially available KDF-2 type of unit, can be adapted so as to be equipped with a central processing unit. A representative central processing unit is available as a Siemens 314-C processor. The central processing unit is equipped with input and output modules. As such, the operation of the rod-making unit can be monitored, and data so generated can be transferred to the central processing unit. In addition, data received by the central processing unit can be presented on a video touch screen or retrieved by a high level operating system (e.g., via an Ethernet). Remote unit such as Siemens IM-153 equipped with inputs, outputs and a counter module available as Siemens FM350-2 installed in sending unit collects data provided to the central processing unit using a bus system (e.g., Profibus). Depending upon information gathered, data that can be generated may relate to number of filter rods manufactured during a particular time frame, machine operating speed, manufacturing efficiency, number of stops, filters sent to a making machine and stoppage reasons.

Figure 2:
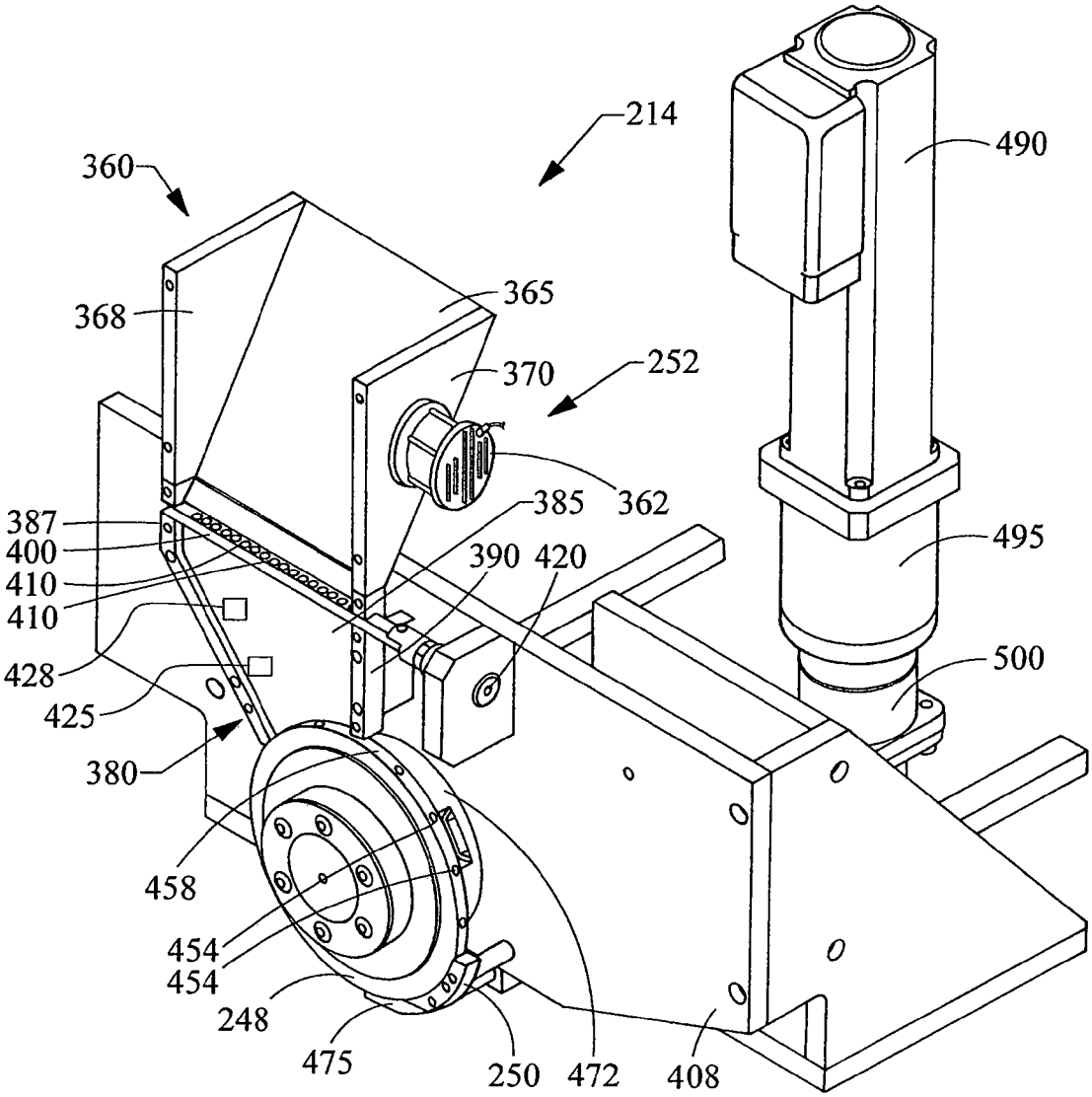
FIG. 2 is a perspective of an object insertion unit.

Referring to FIG. 2, the insertion unit 214 includes a frame 308 that supports a hopper assembly 252. The frame 408 also is used to attach and secure the insertion unit 214 to the chassis or frame of the rod-making unit (not shown). That hopper assembly 252 possesses an upper hopper 360 or reservoir having an inner region for containing and transferring objects (not shown). The overall shape of that hopper can vary, and the number of objects that the hopper can hold can vary. The manner by which the hopper is loaded with objects can vary. For example, the hopper can be filled using tubular feed and an air transport system, using a conveyor system, manually by pouring objects from a container, or the like.

The upper hopper 360 generally has the overall function of a funnel, whereby a relatively large number of objects are received, aligned in a controlled manner, and supplied to a downstream location in a controlled manner. Preferably, the upper hopper 360 has a general wedge shape, whereby the upper region of that hopper that is adapted to contain and permit passage of objects has a relatively great cross-sectional area, and the lower region of that hopper is adapted to contain objects so that those objects are arranged in a vertical plane approaching a single layer of objects in thickness (i.e., a plurality of objects are contained in the bottom region of upper hopper so as to be aligned in a single line or as a single layer). For example, for objects having diameters of about 3.5 mm, the width of the lower region of the upper hopper can be about 4 mm.

The front panel (not shown) of the upper hopper 360 can be provided by a sheet of material positioned so as to form the front wall of the upper hopper assembly, and hence can provide for containment of the objects with the hopper in the desired manner. The front panel can be manufactured from a flat sheet of clear polycarbonate or polymethylmethacrylate in order that the movement of objects through the hopper assembly can be visually observed during operation of the rod-making unit. The hopper also possesses a back wall 365, left side wall 368 and right side wall 370. The front panel also can be secured to the hopper assembly using bolts, clamps, or other suitable connection means, in order that the front panel can be readily removed from the hopper assembly for servicing, cleaning, and the like.

The upper hopper 360 optionally, though preferably, can be equipped with a vibrating unit 362, or other means for ensuring free flow of objects through the hopper. Preferably, the vibrating unit may be located on the back wall 365 of the hopper, or anywhere else, such as the right side wall 370, as shown. A representative vibrating unit is available as SYNTRON Magnetic Vibrator, Serial GPVB00216 from FMC Technologies Corporation, Philadelphia, Pa. As such, gravity feed of the objects is enhanced, and there is avoided or prevented blockage of the hopper to a desirable flow of objects. As such, there is provided a reliable and consistent feed of objects into the bottom region of the upper hopper. The vibrating unit preferably is positioned on the outside of the upper hoper, near the central region of the back panel 365. The vibration that is provided to the upper hopper (and hence to the plurality of objects within that hopper) is sufficient to minimize or prevent blockage of objects in the hopper, and hence promote free flow of objects to locations further downstream in the rod manufacturing process. The operation of such a vibrating unit can be constant or intermittent. Preferably, the operation of the vibrating unit is suitably connected and programmed to commence and continue operation during operation of the object insertion unit of the filter-rod making unit.

The hopper assembly 252 also includes a lower hopper 380. Objects (not shown) are fed from the upper hopper 360 to the lower hopper 380. The front panel (not shown) of the lower hopper 380 can be provided by a sheet of material positioned so as to form the front wall of the lower hopper assembly, and hence can provide for containment of the objects with the hopper in the desired manner. The front panel can be manufactured from clear polycarbonate or polymethylmethacrylate in order that the movement of objects through the hopper assembly can be visually observed during operation of the rod-making unit. The lower hopper 380 also possesses a back wall 385, left side wall 387, and right side wall 390. The front panel also can be secured to the hopper assembly using bolts, clamps, or other suitable connection means, in order that the front panel can be readily removed from the hopper assembly for servicing, cleaning, and the like.

A reciprocating bar 400 is positioned between the upper hopper 360 and the lower hopper 380, and provides for controlled feed of objects into from the upper hopper to the lower hopper. The reciprocating bar 400 provides a type of screening means that facilitates transfer of objects at a desired rate from the upper hopper into the lower hopper. The reciprocating bar 400 is moved back and forth from left to right in order to urge objects (not shown) from the bottom region of the upper hopper 360 to drop into the lower hopper 380. The objects (not shown) pass from the upper hopper into the lower hopper through passageways 410 (e.g., a plurality of vertical passageways) in the reciprocating bar. In a highly preferred embodiment, using spherical objects as the objects to be inserted, the only manner that the objects pass from the upper hopper to the lower hopper is through passageways in the reciprocating bar. An exemplary reciprocating bar operates at a stroke of about 5 mm. The reciprocating bar is operated using a plunger arm 420, and the frequency of reciprocation is controlled by an air valve (not shown). A lower level detector 425 and an upper level detector 428 in the lower hopper 380 each sense the levels of objects in that hopper. Representative photoelectric detector components for each of those detectors are available as Keyence amplifier FS-V21RP and Fiber Optic FU-42TZ.

It is desirable to maintain a minimum number of objects in the lower hopper 380 during operation; and hence, when the level of objects falls below the region controlled by the lower level detector 425, the plunger arm 420 is activated via the air valve so as to operate at a high frequency. It is desirable to maintain a maximum number of objects in the lower hopper during operation in order to enhance the ability of the objects to move freely for further transport through the filter rod-making unit; and hence, when the level of objects rises above the region controlled by the upper level detector 428, the plunger arm 420 is activated via the air valve so as to operate at a lower frequency or may be turned off. Typical frequencies range from about 0.5 Hz to about 2 Hz.

The object insertion unit 252 includes a rotatable wheel 248 having a series of pockets 454 positioned at predetermined intervals along the periphery thereof. The pockets 454 that are positioned along the peripheral face 458 of the wheel preferably are located at equally spaced intervals. The diameter of the wheel and the number of pockets present in the peripheral face of the wheel generally are dependent upon factors such as the speed of rotation of the wheel, and the desired spacing of the individual objects within the continuous filter rod. For example, a wheel of about 108 mm diameter can have 32 pockets, the centers of which are equally spaced from one another. As another example, a wheel of about 158 mm diameter can have 16 pockets, the centers of which are equally spaced from one another. The wheel 248 is manufactured from aluminum, from pre-tempered, cold-rolled steel, or other suitable material.

The width of wheel 248 can be determined by factors such as the circumference of the continuous rod that is manufactured and the diameter of the objects. Generally, the width of the wheel 248 is the width of the peripheral face of the wheel. Of particular interest is a wheel having a width of about 6 mm to about 6.5 mm. A wheel with such a width can conveniently be used for the manufacturing of rods having a circumference of about 25 mm. The width of each pocket is less than the width of the peripheral face of the wheel, and typically is determined by the diameter of the object, such as a capsule, that enters the pocket (i.e., the width of the pocket is greater than the diameters of the object and the object seat).

The lower hopper 380 is open on its bottom, and the bottom of the lower hopper is shaped so as to cooperate with a portion of upper region of a rotating wheel 248 that is positioned so as to rotate in a vertical plane. That is, the front plate (not shown) and the back panel 385, which define the front and back walls of the lower hopper, as well as the left wall 387 and the right wall 390, are adapted so as to fit over a portion of the peripheral face of the rotating wheel. Each pocket in the peripheral face of the wheel is of sufficient shape and size to accommodate one object, such as shown in Deal, U.S. Pat. Appl. Pub. No. 2005/0070409 A1. The open bottom of the lower hopper 380 typically can extend over about 5 percent to about 30 percent, often about 8 to about 20, and frequently about 10 to about 15 percent, of the periphery of the wheel 248. The spacing between the rotating wheel 248 and the bottom region of the lower hopper 380 is such that the wheel can rotate freely, while objects within the hopper are urged against the peripheral face of the wheel and hence are allowed to become positioned in the pockets 454 of that wheel. Thus, the lower or feed hopper 380 receives objects from the upper hopper 360, and positions those objects along a portion of the periphery of the insertion wheel 248. The objects within the bottom region of the lower hopper 380 preferably are in a direct contact with the peripheral face 458 of the insertion wheel 248 and ride over that surface. Thus, the objects are feed from the lower hopper in a single line (e.g., about 15 to about 20 objects aligned end-to-end) extending along the peripheral face of a rotating wheel. That is, the line of objects defined by the stack of objects at a depth of one layer is aligned with a portion of the peripheral face of the rotating wheel. With vacuum assistance applied to the insertion wheel pockets 454, each pocket grabs an object as the pocket rotates inside the open bottom of the feed hopper 380. The stack of objects (not shown) of single-layer thickness (such depth determined by looking inwards into the unit) can empty one object into each pocket 454 on the rotating wheel 248. For example, for a situation in which capsules of about 3.5 mm diameter are employed, the front and back walls are aligned such that the inner faces of each of those walls are parallel or nearly parallel to one another, and those inner walls can be spaced about 4 mm from one another.

Each individual object (not shown) remains well positioned in each respective pocket 454 of the rotating wheel 248 until the insertion of the object into the web of filter material (not shown) is desired. Near the bottom region of the wheel, the ledger housing 250 does not cover the wheel as a rim, and the object then is inserted into the web of filter material with the assistance of air ejection resulting from airflow provided through the bearing housing 472. The pressurized air flow is received from a source (not shown) such as a laboratory air supply, or other suitable means. In such a manner, the action of gravity and pressurized air flow force the object from the pocket into the web of filter material. In particular, the rim-like nature of the ledger housing 250 and plow 475 relative to each pocket 454, and the relative close spacing of the inner surface of the ledger housing and plow relative to the outer face of the wheel 248, in combination with the supply of vacuum on each pocket (e.g., for sucking the object into the pocket, in order that the object can be secured within the pocket for transport) and a blast of airflow (e.g., for blowing or air ejecting the object from the pocket) allows each individual object to be maintained within the respective pocket, preferably without moving from, or wobbling within, the pocket, until each object is efficiently and effectively deposited within the moving web of filter material. Other techniques for assuring removal of each object from each pocket at the desired location (e.g., the use of mechanical or pneumatic plungers) may be apparent to the skilled artisan.

A preferred insertion unit 214 includes a servo unit 490 coupled with a suitable gear reducer 495 (e.g., having a 10:1 gear reduction ratio). A right angle gear 500 (e.g., having a gear ratio of 1:1) provides rotary motion to the wheel 248 via a timing pulley, or other suitable mechanical means. Once the drive of the servo unit is given the drive enable signal, the objects are inserted into the continuous web at a speed governed by the cutting head speed. That is, the servo unit receives information from the processing unit (not shown), and advances or retards the rotating wheel by speeding up or slowing down that wheel, in order to maintain the desired relationship between the positions of the pockets on the peripheral face of the wheel with the position of the knife of the severing unit (not shown). As a result, the positioning of the objects within each pocket 454, the rate of rotation of the wheel 248, and subsequent positioning of the objects within the resulting filter rod are synchronized with respect to the rate at which the filter material is fed into the rod-forming unit.

Figure 3:
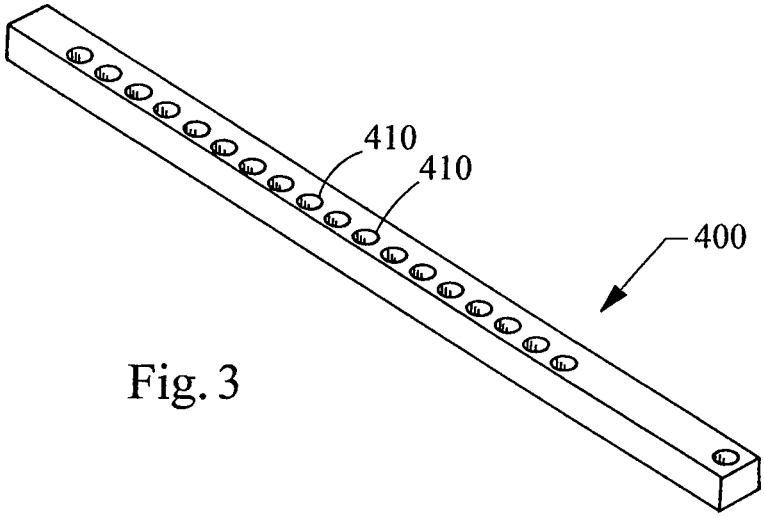
FIG. 3 is a perspective of a reciprocating bar of the object insertion unit of FIG. 5.

Referring to FIG. 3, the reciprocating bar 400 is manufactured from aluminum, or other suitable material. The reciprocating bar possesses a plurality of passageways 410 extending vertically through the bar. A representative reciprocating bar is generally rectangular in cross-sectional shape, and has a length of about 150 mm, a height of 6 mm, and a width of about 8 mm. Such a representative reciprocating bar can possess 18 passageways, equally spaced, each of about 4 mm in diameter; and such a reciprocating bar can be used to maintain a continuous supply of objects of about 3.5 mm diameter in the lower hopper.

Referring to FIG. 4, the continuous web of filter material 40 is fed into guide or block 230 (shown as partially cut away). The block 230 receives the wide band of filter material 40, and gradually forms the web into a composite, which generally resembles a cylindrical composite. The plow region 475 of the ledger housing 250 separates or spreads the filter material 40 such that the object 50 is positioned or placed from a pocket 454 in the peripheral face 458 of the wheel 248 at the desired location within the web of filter material. When the tow reaches the endmost portion of the plow, the motion of the tow acts to close itself into a cylindrical composite, which encloses, surrounds or contains each individual object at the desired location within the continuous web. A suitable plow preferably extends to a maximum depth of about 6 mm to about 6.5 mm into the web of filter material. The insertion unit can be raised or lowered in order that the object is inserted at the desired depth within the filter material. In such a manner, a series of objects 50 is positioned in the web of filter material at predetermined intervals within the cylindrical composite that exits the block 230 and enters the tongue 232 or other suitable gathering means.

Referring to FIG. 5, the guide or block 230 (the top portion of which is shown as partially cut away) has a relatively wide opening 520 at one end in order that the filter material 40 can be fed therein. A suitable wide opening is about 12 mm high and about 65 mm in width. A suitable block has a length of about 130 mm to about 140 mm. The shape of the hollow inner portion of the block is such that the filter material is formed into a composite, which more generally resembles a cylinder. A suitable composite is about 10 mm to about 15 mm in diameter. In particular, the inner portion of the block 230 is a hollow region or cavity in order that the filter material can be passed therethrough. The block has a longitudinally extending slot 523 along the top portion thereof in order to allow the rotating wheel and ledger housing (not shown) to extend into the web of filter material and to insert an object 50 at the desired location therein. A suitable slot 523 is about 90 mm to about 110 mm long for a block having a length of about 130 mm to about 140 mm. In a suitable situation, the plow (not shown) extends into the slot 523 so as to extend about 0.3 mm to about 0.4 mm from the extreme bottom portion of the hollow inner portion of the block. The resulting cylindrical composite 525 is received to further downstream processing regions of the rod-forming unit. Similar types of blocks are set forth in U.S. Pat. No. 4,862,905 to Green, Jr. et al.

Figure 6:
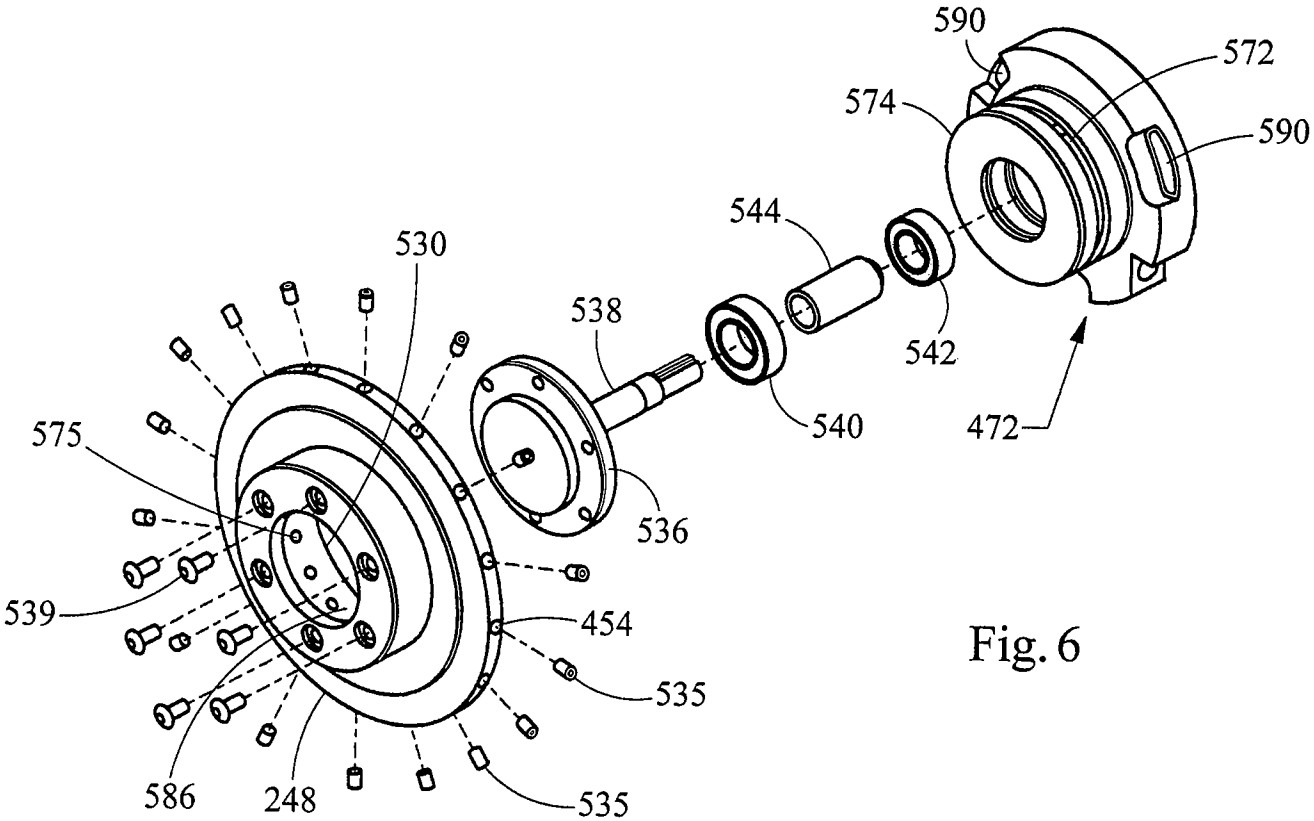
FIG. 6 is an exploded perspective of the object insertion wheel assembly.

Referring now to FIG. 6, the rotatable wheel 248 and associated components are depicted in an exploded perspective view. Suitable components of such a type of assembly are set forth in US Pat. Applic. Pub. No. 2005/0070409 A1 to Deal. The insertion wheel 248 includes a series of pockets 454 spaced around the peripheral face 458 of the wheel. The pockets are holes drilled through the wheel extending all the way through and in communication with the center opening 530 of the wheel. Within each pocket 454, an object seat 535 is positioned near the radial end of the pocket. The object seat 535 is generally a hollow, ribbed structure that provides a seat or cradle to retain the object as the wheel rotates.

The insertion wheel 248 is mounted onto a mounting flange 536 of the drive shaft 538. A set of bolts 539 through the outboard surface of the insertion wheel retains the wheel against the mounting flange. The drive shaft 538 is inserted through a set of ball bearings 540 and 542 separated by a bushing 544 and retained by traditional methods within the bearing housing 472. The bearing housing includes a vacuum port (not shown) in communication with a vacuum channel 572 that is cut into the outside peripheral surface of the hub 574. A positive air supply port (not shown) in the bottom peripheral face of the hub of the bearing housing is channeled through to the bearing housing hub 574; and as the wheel 248 rotates, air flows from the port on the hub through each successive channel 575 at a single point on the wheel. That point corresponds to the location where a pocket is positioned to insert into the filter material; and as such, an object carried in a pocket is blown from that pocket when the appropriate peripherally extending air channel within the wheel is properly aligned in airflow communication with the air supply port on the bottom periphery of the hub. The insertion wheel 248 fits down over the bearing housing hub 574 so that the inside surface 586 of the insertion wheel 248 can rotate around the hub 574 with the insertion wheel pockets 454 riding over the vacuum channel 572. The drive shaft 538 is centered inside the bearing housing 472 so that it retains the insertion wheel 248 concentrically about the bearing housing hub to maintain a small air gap between the hub and the inside surface 586, and hence no undesirable contact between those parts. In this manner, a vacuum seal is provided between the bearing housing and the insertion wheel without the need for bearings, bushings or other contacting seals between the two parts. Bolt holes 590 are provided around the perimeter of the bearing housing to allow for adjustable mounting of the bearing housing to a support bracket (not shown) on the rod-making apparatus.

Figure 7:
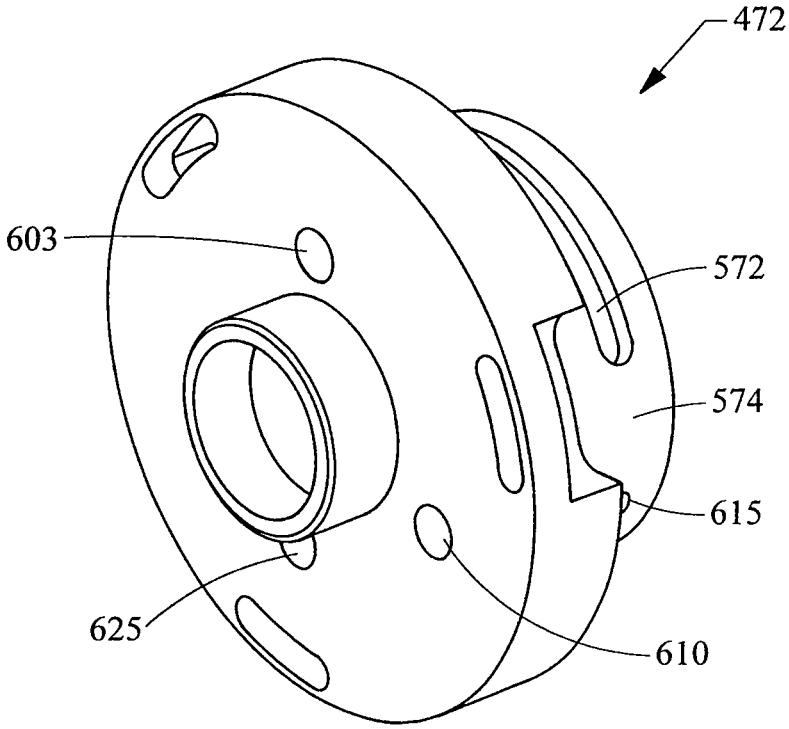
FIG. 7 is a perspective of the mounting housing for the object insertion wheel assembly.

Referring to FIG. 7, a back view of the bearing housing 472 described previously with reference to FIG. 6 is shown. Vacuum port 603 is in communication with a vacuum channel 572 via a passage (not shown) drilled out from the backside of the bearing housing. The vacuum can be supplied by a normal laboratory vacuum system and an appropriate hose (not shown) connected to that port, or other suitable means. The vacuum supply is used to apply a vacuum to the various pockets on the peripheral face of the rotatable wheel (not shown) in order that an individual object (not shown) can be sucked into, and secured in place within, an individual pocket. Also, a positive air supply port 610 is in communication with a drilled out air supply passage 615 located in the peripheral face of the hub 574. The air supply can be supplied by a normal laboratory pressurized air supply system and an appropriate hose (not shown) connected to that port, or other suitable means. The air supply through air supply passage 615 is such that residual objects or other residual material is cleaned from each pocket in the peripheral face of the wheel (not shown) after the object should have been released from the pocket and inserted into the filter tow (not shown). Also, a positive air supply port 625 is in communication with a drilled out air supply passage (not shown) located in the bottom peripheral face of the hub 574. The air supply through air supply passage 625 is such that an individual object is forced from each pocket on the peripheral face of the wheel (not shown) by a blast of air from in that passage and through an individual peripherally extending air passageway of the wheel. As such, as the wheel possessing a pocket carrying an object rotates to a low position, that region of the wheel is positioned within the moving filter tow. The vacuum (e.g., negative air supply) applied to that pocket is blocked, and air supply (e.g., positive air supply) from air supply passage 615 passes through the air passageway extending to that pocket, as a result of the alignment of passage of air from the port (not shown) located on the bottom peripheral face of the hub. The resulting burst of air through that passageway forces the object from the pocket and into the filter tow.

Preferred types of objects and the dimensions thereof are set forth below. The object can vary. The object typically possesses a generally spherical shape, and most preferably is highly spherical in nature. The object can be generally solid in nature. The object can be composed of a plastic material; and can be for example, a solid spherical bead composed of a mixture of polyethylene and flavor, or a spherical bead having the form of exchange resin or gel. The object can be composed of an inorganic material; and can be for example, a spherical alumina bead. The object also can have the form of a spherical bead composed of a carbonaceous material. The object also can have the form of a hollow sphere. Typical hollow objects are liquid-containing objects, such as breakable capsules, which are highly spherical, are uniform in size and weight, have surface properties that allow the objects to be processed efficiently and effectively using automated filter making equipment, and are highly uniform in composition. Typical objects have diameters of about 3 mm to about 4 mm, preferably about 3.5 mm, and the components of the preferred filter rod-making equipment of the present invention is suitably adapted or designed to efficiently and effectively produce filter rods incorporating those types of objects. Preferred hollow objects have sufficient physical integrity to not rupture during conditions of handling experienced during transport to, from and within the hopper assembly 252.

Other types of objects, beads, capsules and capsule components that can be employed for the production of filter rods using the foregoing filter rod manufacturing techniques and equipment are of the type set forth in U.S. Pat. No. 3,685,521 to Dock; U.S. Pat. No. 3,916,914 to Brooks et al.; and U.S. Pat. No. 4,889,144 to Tateno et al.; US Pat. Appl. Pub. No. 2003/0098033 to MacAdam et al. and 2004/0261807 to Dube et al.; and PCT Application Pub. No. WO 03/009711 to Kim; which are incorporated herein by reference.

Figure 8:
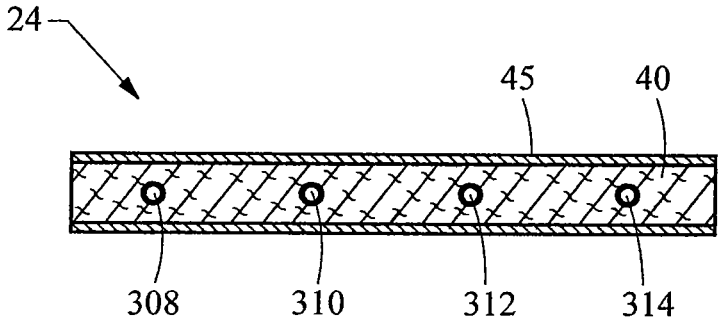
FIG. 8 is a cross-sectional view of a representative filter rod including filter material and objects positioned at predetermined intervals therein

Referring to FIG. 8, filter rod 24 generally can be further subdivided into cylindrical shaped filter elements using techniques as are known by the skilled artisan familiar with conventional cigarette manufacturing, and as described above. The filter rod 24 includes filter material 40 encased in circumscribing wrapping material 45 such as conventional air permeable or air impermeable paper plug wrap, or other suitable wrapping material. As an example, four objects 308, 310, 312 and 314 are individually spaced at predetermined intervals within the rod 24. In particular, each of the objects is positioned along the rod in a spaced apart relationship from one another. As shown by lines 1-1, 2-2 and 3-3, respectively, the rod can be used as a "four up" rod to provide four filter elements by cutting the rod along the indicated lines 1-1, 2-2 and 3-3. Other configurations such as the so called "six up" rods also can be manufactured. Rod sizes for use in the manufacture of filter elements for cigarettes can vary, but typically range in length from about 80 mm to about 140 mm, and from about 16 mm to about 27 mm in circumference. For example, a typical rod having a 100 mm length and a 24.53 mm circumference exhibits a pressure drop of from about 200 mm to about 400 mm of water as determined at an airflow rate of 17.5 cc/sec. using an encapsulated pressure drop tester, sold commercially as Model No. FTS-300 by Filtrona Corporation.

Figure 9:
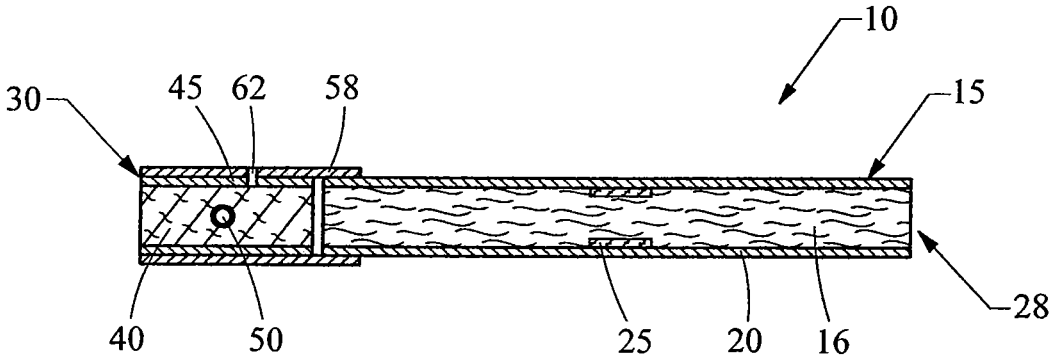
FIG. 9 is a cross-sectional view of a smoking article having the form of a cigarette, showing the smokable material, the wrapping material components, and the object-containing filter element of that cigarette.

Referring to FIG. 9, there is shown a smoking article 10, such as a cigarette, possessing certain representative components of a smoking article. The cigarette 10 includes a generally cylindrical rod 15 of a charge or roll of smokable filler material 16 contained in a circumscribing wrapping material 20. The rod 15 is conventionally referred to as a "tobacco rod." The ends of the tobacco rod are open to expose the smokable filler material. The cigarette 10 is shown as having one optional band 25 (e.g., a printed coating including a film-forming agent, such as starch, ethylcellulose, or sodium alginate) applied to the wrapping material 20, and that band circumscribes the cigarette rod in a direction transverse to the longitudinal axis of the cigarette. That is, the band provides a cross-directional region relative to the longitudinal axis of the cigarette. The band can be printed on the inner surface of the wrapping material (i.e., facing the smokable filler material) as shown, or less preferably, on the outer surface of the wrapping material. Although the cigarette can possess a wrapping material having one optional band, the cigarette also can possess wrapping material having further optional spaced bands numbering two, three, or more.

The wrapping material 20 of the tobacco rod 15 can have a wide range of compositions and properties. The selection of a particular wrapping material will be readily apparent to those skilled in the art of cigarette design and manufacture. Tobacco rods can have one layer of wrapping material; or tobacco rods can have more than one layer of circumscribing wrapping material, such as is the case for the so-called "double wrap" tobacco rods. Exemplary types of wrapping materials, wrapping material components and treated wrapping materials are described in U.S. Pat. No. 5,220,930 to Gentry; and U.S. Pat. Application Pub. Nos. 2004/0129281 to Hancock et al.; and 2005/0039764 to Barnes et al.; and PCT Application Pub. No. WO 2004/057986 to Hancock et al.; and PCT Application Pub. No. WO 2004/047572 to Ashcraft et al.; which are incorporated herein by reference in their entireties.

At one end of the tobacco rod 15 is the lighting end 28, and at the other end is positioned a filter element 30. The filter element 30 positioned adjacent one end of the tobacco rod 15 such that the filter element and tobacco rod are axially aligned in an end-to-end relationship, preferably abutting one another. Filter element 30 may have a generally cylindrical shape, and the diameter thereof may be essentially equal to the diameter of the tobacco rod. The ends of the filter element permit the passage of air and smoke therethrough. The filter element 30 includes filter material 40 (e.g., cellulose acetate tow impregnated with triacetin plasticizer) that is overwrapped along the longitudinally extending surface thereof with circumscribing plug wrap material 45. That is, the filter element 30 is circumscribed along its outer circumference or longitudinal periphery by a layer of plug wrap 45, and each end is open to expose the filter material 40.

Within the filter element 30 is positioned at least one object 50. The number of objects within each filter element, most preferably is a pre-determined number, and that number can be 1, 2, 3, or more. Most preferably, each filter element contains a single object. Preferably, the object is disposed within the filter material 40 of the filter element, particularly towards the central region of the filter element. Most preferably, the nature of the filter material 40 is such that the object 50 is secured or lodged in place within the filter element 30. Each object 50 may be hollow, such as a breakable capsule, that may carry a payload incorporating a compound that is intended to introduce some change to the nature or character of mainstream smoke drawn through that filter element (e.g., a flavoring agent). That is, the shell of hollow object 50 may be ruptured at the discretion of the smoker to release the object payload. Alternatively, the object 50 may be a solid, porous material with a high surface area capable of altering the smoke and/or air drawn through the filter element. The object may be a solid material, such as a polyethylene bead, acting as a substrate or matrix support for a flavoring agent. Highly preferred objects are capable of releasing the agent at the command of the user. For example, a preferred breakable hollow object containing a liquid payload is resistant to the release of the payload until the time that the smoker applies a purposeful application of physical force sufficient to rupture the hollow object. Typically, a filter material, such as cellulose acetate tow, is generally absorbent of liquid materials of the type that comprise the payload, and hence the released payload components are capable of undergoing wicking (or otherwise experiencing movement or transfer) throughout the filter element.

The filter element 30 is attached to the tobacco rod 15 using tipping material 58 (e.g., essentially air impermeable tipping paper), that circumscribes both the entire length of the filter element 30 and an adjacent region of the tobacco rod 15. The inner surface of the tipping material 58 is fixedly secured to the outer surface of the plug wrap 45 and the outer surface of the wrapping material 20 of the tobacco rod, using a suitable adhesive; and hence, the filter element and the tobacco rod are connected to one another.

The tipping material 58 connecting the filter element 30 to the tobacco rod 15 can have indicia (not shown) printed thereon. For example, a band on the filter end of a cigarette (not shown) can visually indicate to a smoker the general location or position of the object 50 within the filter element 30. These indicia may help the smoker to locate the object 50 so that it can be more easily ruptured by squeezing the filter element 30 directly outside the position of the object. The indicia on the tipping material 58 may also indicate the nature of the payload carried by the object. For example, the indicia may indicate that the particular payload is a spearmint flavoring by having a particular color, shape, or design. If desired, the inner surface (i.e., the surface facing the plug wrap) of the tipping material can be coated with a material that can act to retard the propensity of ruptured object contents from migration, wicking or bleeding from the filter material 40 into the tipping material, and hence causing what might be perceived as unsightly visible staining of the tipping material. Such a coating can be provided using a suitable film-forming agent (e.g., ethylcellulose, or a so-called lip release coating composition of the type commonly employed for cigarette manufacture).

A ventilated or air diluted smoking article can be provided with an optional air dilution means, such as a series of perforations 62, each of which extend through the tipping material and plug wrap. The optional perforations 62 can be made by various techniques known to those of ordinary skill in the art, such as laser perforation techniques. As these techniques are carried out after insertion of an object 50 into the filter element 30, care is taken to avoid damaging the objects during the formation of the perforations 62. One way to avoid damage from air dilution techniques, such as those employing laser perforation technologies, involves locating the perforations at a position adjacent to the position of the object 50. In such a manner, radiation, heat or physical forces acting upon the filter element during perforation processes do not have such a great propensity to damage the object. Alternatively, so-called off-line air dilution techniques can be used (e.g., through the use of porous paper plug wrap and pre-perforated tipping paper). The perforated region can be positioned upstream of the object (as shown), or the perforated region can be positioned downstream of the object (i.e., towards the extreme mouth-end of the filter element).

The plug wrap 45 can vary. See, for example, U.S. Pat. No. 4,174,719 to Martin. Typically, the plug wrap is a porous or non-porous paper material. Plug wrap materials are commercially available. Exemplary plug wrap papers are available from Schweitzer-Maudit International as Porowrap Plug Wrap 17-M1, 33-M1, 45-M1, 65-M9, 95-M9, 150-M4, 260-M4 and 260-M4T. Preferred plug wrap materials are non-porous in nature. Non-porous plug wraps exhibit porosities of less than about 10 CORESTA units, and preferably less than about 5 CORESTA units. Exemplary non-porous plug wrap papers are available as Ref. No. 646 Grade from Olsany Facility (OP Paprina) of the Czech Republic (Trierendberg Holding). Plug wrap paper can be coated, particularly on the surface that faces the filter material, with a layer of a film-forming material. Such a coating can be provided using a suitable polymeric film-forming agent (e.g., ethylcellulose, ethylcellulose mixed with calcium carbonate, or a so-called lip release coating composition of the type commonly employed for cigarette manufacture). Alternatively, a plastic film (e.g., a polypropylene film) can be used as a plug wrap material. For example, non-porous polypropylene materials that are available as ZNA-20 and ZNA-25 from Treofan Germany GmbH & Co. KG can be employed as plug wrap materials.

The use of non-porous plug wrap materials is desirable in order to avoid the contents of ruptured objects within filter elements from causing what might be perceived as unsightly visible staining of the tipping material 58. For example, highly non-porous plug wrap materials can act to retard or block the propensity of liquid contents of the ruptured object from migration, wicking or bleeding from the filter material 40 into the tipping material.

Tobacco materials 16 useful for carrying out the present invention can vary. Tobacco materials can be derived from various types of tobacco, such as flue-cured tobacco, burley tobacco, Oriental tobacco or Maryland tobacco, dark tobacco, dark-fired tobacco and Rustica tobaccos, as well as other rare or specialty tobaccos, or blends thereof. Descriptions of various types of tobaccos, growing practices, harvesting practices and curing practices are set for in *Tobacco Production, Chemistry and Technology*, Davis et al. (Eds.) (1999). Most preferably, the tobaccos are those that have been appropriately cured and aged.

Typically, tobacco materials for cigarette manufacture are used in a so-called "blended" form. For example, certain popular tobacco blends, commonly referred to as "American blends," comprise mixtures of flue-cured tobacco, burley tobacco and Oriental tobacco. Such blends, in many cases, contain tobacco materials that have a processed form, such as processed tobacco stems (e.g., cut-rolled or cut-puffed stems), volume expanded tobacco (e.g., puffed tobacco, such as dry ice expanded tobacco (DIET), preferably in cut filler form). Tobacco materials also can have the form of reconstituted tobaccos (e.g., reconstituted tobaccos manufactured using paper-making type or cast sheet type processes). The precise amount of each type of tobacco within a tobacco blend used for the manufacture of a particular cigarette brand varies from brand to brand. See, for example, *Tobacco Encyclopedia*, Voges (Ed.) p. 44-45 (1984), Browne, *The Design of Cigarettes,* 3rd Ed., p. 43 (1990) and *Tobacco Production, Chemistry and Technology*, Davis et al. (Eds.) p. 346 (1999). Other representative tobacco types and types of tobacco blends also are set forth in U.S. Pat. No. 4,836,224 to Lawson et al.; U.S. Pat. No. 4,924,888 to Perfetti et al.; U.S. Pat. No. 5,056,537 to Brown et al.; U.S. Pat. No. 5,220,930 to Gentry; and U.S. Pat. No. 5,360,023 to Blakley et al.; US Pat. Application Pub. Nos. 2002/0000235 to Shafer et al.; 2004/0084056 to Lawson et al.; 2004/0255965 to Perfetti et al. and 2004/0261807 to Dube et al., 2005/0066981 to Crooks et al.; and 2005/0066986 to Nestor et al.; PCT Application Pub. No. WO 02/37990; and Bombick et al., *Fund Appl. Toxicol.*, 39, p. 11-17 (1997).

Tobacco materials typically are used in forms, and in manners, that are traditional for the manufacture of smoking articles, such as cigarettes. The tobacco normally is used in cut filler form (e.g., shreds or strands of tobacco filler cut into widths of about 1/10 inch to about 1/60 inch, preferably about 1/20 inch to about 1/35 inch, and in lengths of about 1/4 inch to about 3 inches). The amount of tobacco filler normally used within the tobacco rod of a cigarette ranges from about 0.6 g to about 1 g. The tobacco filler normally is employed so as to fill the tobacco rod at a packing density of about 100 mg/cm$^3$ to about 300 mg/cm$^3$, and often about 150 mg/cm$^3$ to about 275 mg/cm$^3$.

If desired, the tobacco materials of the tobacco rod can further include other components. Other components include casing materials (e.g., sugars, glycerin, cocoa and licorice) and top dressing materials (e.g., flavoring materials, such as menthol). The selection of particular casing and top dressing components is dependent upon factors such as the sensory characteristics that are desired, and the selection of those components will be readily apparent to those skilled in the art of cigarette design and manufacture. See, Gutcho, *Tobacco Flavoring Substances and Methods*, Noyes Data Corp. (1972) and Leffingwell et al., *Tobacco Flavoring for Smoking Products* (1972).

The dimensions of a representative cigarette 10 can vary. Preferred cigarettes are rod shaped, and can have diameters of about 7.5 mm (e.g., circumferences of about 22.5 mm to about 25 mm); and can have total lengths of about 80 mm to about 100 mm. The length of the filter element 30 can vary. Typical filter elements can have lengths of about 20 mm to about 40 mm. In one preferred embodiment, the length of the filter element 30 is about 27 mm, and the length of the tobacco rod 15 is about 56 mm to about 57 mm. In another embodiment, the length of the filter element is about 31 mm, and the length of the tobacco rod is about 67 mm to about 68 mm. The tipping paper 58 can circumscribe the entire filter element and about 4 mm of the length of the tobacco rod in the region adjacent to the filter element. A representative object 50, which can have a diameter of about 3 mm to about 4 mm, can be positioned in the central region of the filter element.

The filter element 30 typically contains a predetermined number of objects at a predetermined position within the element. For example, the filter element preferably contains one spherical object having a diameter of at least about 1 mm, typically at least about 2 mm, and often at least about 3 mm. Typically, the objects have diameters that do not exceed about 6 mm, often do not exceed about 5 mm, and frequently do not exceed about 4.5 mm. Certain preferred objects have diameters in the range of about 3 mm to about 4 mm in diameter, and certain highly preferred objects are approximately 3.5 mm in diameter. Preferably, the object is positioned in the center third of the filter element, more preferably at the middle of the filter element. For a cigarette having a diameter of about 7 mm to about 8 mm, a typical cellulose acetate tow filter material can readily accept, and maintain in the desired position within the filter element, a single object having a diameter of about 3.5 mm.

Preferred cigarettes made according to the method of the present invention exhibit desirable resistance to draw, whether or not the hollow objects within their filter elements are broken. For example, an exemplary cigarette exhibits a pressure drop of between about 50 mm and about 200 mm water pressure drop at 17.5 cc/sec. air flow. Preferred cigarettes exhibit pressure drop values of between about 70 mm and about 180 mm, more preferably between about 80 mm to about 150 mm water pressure drop at 17.5 cc/sec. air flow. Typically, pressure drop values of cigarettes are measured using a Filtrona Filter Test Station (CTS Series) available form Filtrona Instruments and Automation Ltd.

In use, the smoker lights the lighting end 28 of the cigarette 10 and draws smoke into his/her mouth through the filter element 30 at the opposite end of the cigarette. The smoker can smoke all or a portion of the cigarette with the object 50 intact. During the portion of the smoking experience that the object 50 remains intact, smoke generated in the tobacco rod 15 is drawn to the smoker through the filter material 40 of the filter element. Most preferably, the overall character or nature of the drawn smoke is virtually unaffected to any significant degree as a result of the presence of the intact object within the filter element. If desired, the smoker may rupture the object 50 at any time before, during, or even after, the smoking experience. Breakage of the object acts to release the contents that are contained and sealed therewithin. Release of the contents of the object into the filter element thus enables the smoker to achieve the intended benefit of action of certain of those contents, whether that benefit results from flavoring or scenting the smoke, cooling or moistening the smoke, freshening the scent of the cigarette butt, or achieving some other goal associated with modifying the overall composition of the smoke or altering the performance characteristics of the cigarette. That is, in highly preferred embodiments, the contents of the object are not released into the filter element until the object is purposefully physically broken; but when the object is ruptured, a portion of component contained within the object (e.g., portions of a flavoring agent) that is consequently released into the filter element is incorporated into each subsequent puff of mainstream smoke that is received through that filter element.

During use of the cigarette, application of physical pressure to the object 50, for example by a squeezing action provided by the fingers of the smoker to the filter element 30, causes relevant regions of the filter element to deform and hence causes the object to rupture and release its payload to the filter material 40 of the filter element. The rupture of the object 50 can be discerned by an audible pop or snap, the feel of a crushing or shattering of the object, or the sense of a rapid decrease in the resistance to the pressure applied by the smoker. Rupture of the object causes contents of its payload to disperse throughout portions of the filter material 40, and potentially to some extent into the tobacco rod 15. Most preferably, the filter element into which the object is placed and maintained is such that the filter element effectively maintains its overall shape during the manufacture, storage and use of the cigarette. Most preferably, the filter element is sufficiently flexible such that the overall cylindrical shape of the filter element returns to essentially its original shape after the application of pressure to the filter element is ceased. That is, the filter element possesses sufficient flexibility to allow squeezing pressure applied by the fingers of the smoker to break the object, and sufficient resilience to allow the deformed filter element to return to its original shape.

Figure 10:
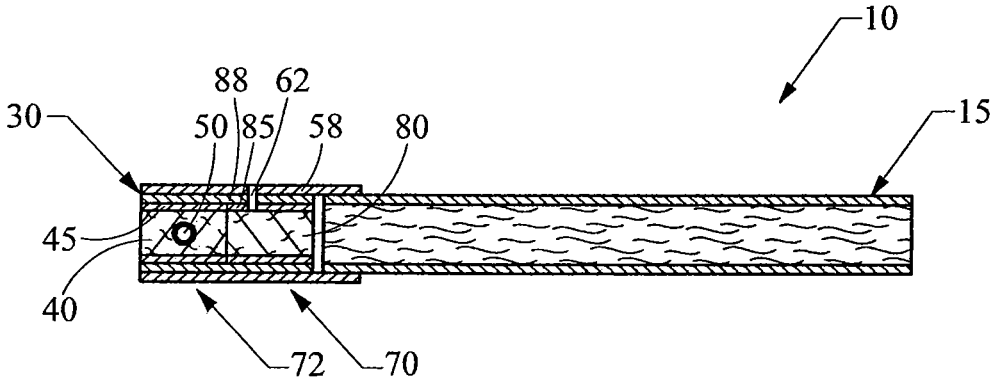
FIG. 10 is a cross-sectional view of a smoking article having the form of a cigarette, showing the smokable material, the wrapping material components, and the object-containing filter element of that cigarette.

Referring to FIG. 10, there is shown a cigarette 10 possessing a tobacco rod 15 having a filter element 30 connected at an end thereof using tipping material 58. The filter element 30 is composed of two longitudinally aligned segments 70, 72. The first segment 70, which is positioned adjacent one end of the tobacco rod 15, preferably in an abutting end-to-end relationship, possesses a filter material 80 and a circumscribing plug wrap 85. The second segment 72 is positioned adjacent the first segment 70, preferably in an abutting end-to-end relationship, at the extreme mouthend of the cigarette. The second segment 72 incorporates filter material 40 having a rupturable object 50 disposed therein. The longitudinal surface of the second filter element 72 is in turn circumscribed by plug wrap 45. The type of filter element previously described with reference to FIG. 1 can be used to provide the second filter segment 72. Each of those segments 70, 72 are maintained in place relative to one another using plug wrap 88 that circumscribes the outer longitudinally extending surfaces of both of those filter segments. A ventilated or air diluted smoking article can be provided with an optional air dilution means, such as a series of perforations 62, each of which extend through the tipping material, as well as the plug wrap 88 for the two filter segments and plug wrap 85 of the first segment 70.

The plug wrap 45 for the region of the second filter segment 72 incorporating the object 50 can be that type of plug wrap material (e.g., non-porous plug wrap) described previously with reference to FIG. 8.

For a typical dual-segment filter element 30, the second filter segment 72 possessing the object 50 typically has a length of about 15 mm to about 30 mm; and the first filter segment 70 has a length of about 5 mm to about 15 mm, most preferably about 10 mm. Preferred dual-segment filter elements 30 have overall lengths of about 25 mm to about 35 mm.

The first segment 70 most preferably is a generally cylindrically shaped filter segment. The first segment most preferably is manufactured using a traditional cigarette filter material, such as cellulose acetate tow, gathered cellulose acetate web, polypropylene tow, gathered polypropylene web, gathered cellulose acetate web, gathered paper, strands of reconstituted tobacco, or the like. Exemplary cigarette filter segments for multi-component cigarette filters are set forth in U.S. Pat. No. 4,920,990 to Lawrence et al.; U.S. Pat. No. 5,012,829 to Thesing et al.; U.S. Pat. No. 5,025,814 to Raker; U.S. Pat. No. 5,074,320 to Jones et al.; U.S. Pat. No. 5,105,838 to White et al.; U.S. Pat. No. 5,271,419 to Arzonico et al.; and U.S. Pat. No. 5,360,023 to Blakley et al.; which are incorporated herein by reference. Carbonaceous material, such as activated charcoal particles, also can be incorporated into that filter segment.

Other types of cigarettes possessing multi-component filters also can be used to incorporate those types of object-containing filter segments representative the present invention. That is, cigarettes can possess multi-component filter elements having other types of formats and configurations. For example, a two-segment filter element can have one segment possessing a rupturable object, and that segment can be positioned between the tobacco rod and the extreme mouth-end filter segment. As another example, a three-segment filter element can have one segment possessing a rupturable object, and that segment can be positioned immediately adjacent the tobacco rod, at the extreme mouth-end of the cigarette, or as the middle filter segment between the tobacco end filter segment and the mouth-end filter segment. Object-containing filter segments made according to the method of the present invention can be incorporated into the multi-component filter of cigarettes of the type set forth in U.S. Pat. No. 5,360,023 to Blakley; U.S. Pat. No. 5,396,909 to Gentry et al.; and U.S. Pat. No. 5,718,250 to Banerjee et al. US Pat. Application Pub. Nos. 2002/0166563 to Jupe et al., 2004/0261807 to Dube et al. and 2005/0066981 to Crooks et al.; and PCT Application Pub. No. WO 03/047836 to Xue et al.; which are incorporated herein by reference. See, also, the representative types of filter elements set forth in U.S. Pat. No. 4,046,063 to Berger; U.S. Pat. No. 4,064,791 to Berger; U.S. Pat. No. 4,075,936 to Berger; U.S. Pat. No. 4,357,950 to Berger; and U.S. Pat. No. 4,508,525 to Berger; which are incorporated herein by reference. For example, the types of objects set forth as cigarette filter components in US Pat. Application Pub. Nos. 2004/0261807 to Dube et al., 2005/0066981 to Crooks et al. and 2005/0070409 to Deal; and PCT Application WO 03/009711 to Kim, which are incorporated herein by reference, can be replaced with the types of objects set forth herein.

If desired, the types of filter elements set forth in U.S. Pat. No. 5,724,997 to Smith et al., which is incorporated herein by reference in its entirety, can incorporate the aforementioned types of objects.

Many modifications and other embodiments of the invention will come to mind to one skilled in the art to which this invention pertains having the benefit of the teachings presented in the foregoing description; and it will be apparent to those skilled in the art that variations and modifications of the present invention can be made without departing from the scope or spirit of the invention. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An apparatus for manufacturing cigarette filter rods, the apparatus comprising:

(a) means for providing a continuous supply of filter material;

(b) means for forming the filter material into a continuous rod;

(c) wheel means rotatable in a vertical plane, possessing pockets positioned in its outermost peripheral face, and in operable communication with the filter material;

(d) a lower hopper in operable communication with the rotatable wheel means, the lower hopper comprising a front panel, a back wall, two side walls connecting the front panel and the back wall, and an open bottom defined by the front panel, the back wall and two side walls, the open bottom of the lower hopper shaped so as to cooperate with a portion of upper region of the wheel means;

(e) an upper hopper in operable communication with the lower hopper, the lower hopper disposed between the wheel means and the upper hopper such that an object may be fed by gravity from the upper hopper through the lower hopper to the rotatable wheel means;

(f) means for wrapping an overwrap material around the filter material;

(g) means for subdividing the continuous rod at pre-determined intervals.

2. The apparatus of claim 1 further comprising a vibrating unit coupled with the upper hopper.

3. The apparatus of claim 1 further comprising a bar positioned between the upper hopper and the lower hopper, wherein the bar includes passageways therethrough providing communication between the upper and lower hopper.

4. The apparatus of claim 1, further comprising a lower level sensor on the lower hopper positioned to detect when objects therein drop below a first position, and an upper level sensor on the lower hopper positioned to detect when objects fill above a second position.

5. The apparatus of claim 4, further comprising a controller in communication with the lower level sensor and the upper level sensor, the controller configured to cause to be applied a mechanical frequency between 0.5 Hz and 2000 Hz when the level of objects within the lower hopper are detected to be below the first position and to cause to turn off or reduce the mechanical frequency when the level of objects within the lower hopper is above a second position.

6. The apparatus of claim 5, wherein the controller is configured to operate a vibrating unit intermittently to maintain the level of objects in the lower hopper between the first and second positions, the vibrating unit coupled with the upper hopper.

7. The apparatus of claim 1, wherein the lower hopper has a front-to-back depth sufficient for maintaining spherical objects disposed therein vertically stacked as a single layer depth.

8. The apparatus of claim 1, wherein the wheel means rotatable in a vertical plane is in operable communication with the lower hopper and the filter material such that at least two of the pockets on the peripheral portion of the wheel means are simultaneously within the lower hopper to receive objects from the lower hopper.

9. The apparatus of claim 1, wherein the upper hopper has a wedge shape, whereby the upper region of the upper hopper has a relatively greater cross-sectional area, and the lower region of the upper hopper has a relatively smaller cross-sectional area.

10. The apparatus of claim 9, wherein the lower region of the upper hopper has a front-to-back depth sufficient for maintaining spherical objects disposed therein in a vertical plane approaching a single layer depth at the bottom of the upper hopper.

* * * * *